US007467083B2

(12) United States Patent
Kondo et al.

(10) Patent No.: US 7,467,083 B2
(45) Date of Patent: Dec. 16, 2008

(54) DATA PROCESSING APPARATUS

(75) Inventors: Tetsujiro Kondo, Tokyo (JP); Tsutomu Watanabe, Kanagawa (JP); Hiroto Kimura, Tokyo (JP)

(73) Assignee: Sony Corporation, Tokyo (JP)

( * ) Notice: Subject to any disclaimer, the term of this patent is extended or adjusted under 35 U.S.C. 154(b) by 630 days.

(21) Appl. No.: 10/239,591

(22) PCT Filed: Jan. 24, 2002

(86) PCT No.: PCT/JP02/00489

§ 371 (c)(1),
(2), (4) Date: Feb. 21, 2003

(87) PCT Pub. No.: WO02/059876

PCT Pub. Date: Aug. 1, 2002

(65) Prior Publication Data

US 2003/0163307 A1 Aug. 28, 2003

(30) Foreign Application Priority Data

Jan. 25, 2001 (JP) ..... 2001-16868

(51) Int. Cl.
*G10L 19/04* (2006.01)
*G10L 19/10* (2006.01)

(52) U.S. Cl. ..... 704/223; 704/219; 704/262; 704/220; 700/94; 375/316

(58) Field of Classification Search ..... 704/223, 704/219, 262, 220; 375/316; 700/94
See application file for complete search history.

(56) References Cited

U.S. PATENT DOCUMENTS 4,868,867 A * 9/1989 Davidson et al. ..... 704/200.1

(Continued)

FOREIGN PATENT DOCUMENTS

EP 450064 10/1991

(Continued)

OTHER PUBLICATIONS

Schroeder et al. "Code Excited Linear Prediction (CELP): High-Quality Speech at Very Low Bit Rates," Proc. IEEE Int. Conf. Acoust. Speech, Signal Processing, pp. 937-940 (1985).*

*Primary Examiner*—Vijay B Chawan
(74) *Attorney, Agent, or Firm*—Frommer Lawrence & Haug LLP; William S. Frommer; Thomas F. Presson

(57) ABSTRACT

The present invention relates to a data processing apparatus capable of obtaining high-quality sound data. A tap generation section 121 generates a prediction tap used for a process in a prediction section 125 by extracting decoded speech data in a predetermined positional relationship with subject data of interest within the decoded speech data such that coded data is decoded by a CELP method and by extracting an I code located in a subframe according to a position of the subject data in the subject subframe. Similarly to the tap generation section 122, a tap generation section 122 generates a class tap used for a process in a classification section 123. The classification section 123 performs classification on the basis of the class tap, and a coefficient memory 124 outputs a tap coefficient corresponding to the classification result. The prediction section 125 performs a linear prediction computation by using the prediction tap and the tap coefficient and outputs high-quality decoded speech data. The present invention can be applied to mobile phones for transmitting and receiving speech.

19 Claims, 15 Drawing Sheets

U.S. PATENT DOCUMENTS

| | | | | |
|---|---|---|---|---|
| 5,233,660 | A | 8/1993 | Chen | |
| 5,305,332 | A | 4/1994 | Ozawa | |
| 5,359,696 | A | 10/1994 | Gerson et al. | |
| 5,361,323 | A | 11/1994 | Murata et al. | |
| 5,634,085 | A | 5/1997 | Yoshikawa et al. | |
| 5,651,091 | A | 7/1997 | Chen | |
| 5,680,507 | A | 10/1997 | Chen | |
| 5,745,871 | A | 4/1998 | Chen | |
| 6,041,297 | A * | 3/2000 | Goldberg | 704/219 |
| 6,691,082 | B1 * | 2/2004 | Aguilar et al. | 704/219 |
| 6,990,475 | B2 * | 1/2006 | Kondo et al. | 706/16 |
| 2001/0000190 | A1 | 4/2001 | Oshikiri et al. | |
| 2003/0055632 | A1 * | 3/2003 | Chen | 704/219 |
| 2003/0152165 | A1 * | 8/2003 | Kondo et al. | 375/316 |

FOREIGN PATENT DOCUMENTS

| | | |
|---|---|---|
| EP | 0 459 358 | 12/1991 |
| EP | 0 488 751 | 6/1992 |
| EP | 0 488 803 | 6/1992 |
| EP | 0 532 225 | 3/1993 |
| EP | 0 602 826 | 6/1994 |
| EP | 1 308 927 | 5/2003 |
| JP | 63-214032 | 9/1988 |
| JP | 1-205199 | 8/1989 |
| JP | 4-30200 | 2/1992 |
| JP | 4-502675 | 5/1992 |
| JP | 4-212999 | 8/1992 |
| JP | 4-213000 | 8/1992 |
| JP | 6-131000 | 5/1994 |
| JP | 6-214600 | 8/1994 |
| JP | 7-50586 | 2/1995 |
| JP | 11-3098 | 1/1999 |
| JP | 2971266 | 8/1999 |
| WO | WO 91/03790 | 3/1991 |

* cited by examiner

FIG. 10A

| POSITION OF SUBJECT DATA WITHIN SUBFRAME | NUMBER OF CLASSES BY I_CODE OF SUBFRAME IMMEDIATELY BEFORE SUBJECT SUBFRAME | NUMBER OF CLASSES BY I_CODE OF SUBJECT SUBFRAME | TOTAL NUMBER OF CLASSES |
|---|---|---|---|
| 1−4 | 512 | 0 | 512 |
| 5−8 | 256 | 2 | 512 |
| 9−12 | 128 | 4 | 512 |
| 13−16 | 64 | 8 | 512 |
| 17−20 | 32 | 16 | 512 |
| 21−24 | 16 | 32 | 512 |
| 25−28 | 8 | 64 | 512 |
| 29−32 | 4 | 128 | 512 |
| 33−36 | 2 | 256 | 512 |
| 37−40 | 0 | 512 | 512 |

FIG. 10B

| POSITION OF SUBJECT DATA WITHIN SUBFRAME | NUMBER OF CLASSES BY I_CODE OF SUBFRAME IMMEDIATELY BEFORE SUBJECT SUBFRAME | NUMBER OF CLASSES BY I_CODE OF SUBJECT SUBFRAME | NUMBER OF CLASSES BY I_CODE OF SUBFRAME IMMEDIATELY AFTER SUBJECT SUBFRAME | TOTAL NUMBER OF CLASSES |
|---|---|---|---|---|
| 1−4 | 16 | 32 | 0 | 512 |
| 5−8 | 8 | 64 | 0 | 512 |
| 9−12 | 4 | 128 | 0 | 512 |
| 13−16 | 2 | 256 | 0 | 512 |
| 17−20 | 0 | 512 | 0 | 512 |
| 21−24 | 0 | 512 | 0 | 512 |
| 25−28 | 0 | 256 | 2 | 512 |
| 29−32 | 0 | 128 | 4 | 512 |
| 33−36 | 0 | 64 | 8 | 512 |
| 37−40 | 0 | 32 | 16 | 512 |

DATA PROCESSING APPARATUS

TECHNICAL FIELD

The present invention relates to a data processing apparatus. More particularly, the present invention relates to a data processing apparatus capable of decoding speech which is coded by, for example, a CELP (Code Excited Linear coding) method into high-quality speech.

BACKGROUND ART

FIGS. 1 and 2 show the configuration of an example of a conventional mobile phone.

In this mobile phone, a transmission process of coding speech into a predetermined code by a CELP method and transmitting the codes, and a receiving process of receiving codes transmitted from other mobile phones and decoding the codes into speech are performed. FIG. 1 shows a transmission section for performing the transmission process, and FIG. 2 shows a receiving section for performing the receiving process.

In the transmission section shown in FIG. 1, speech produced from a user is input to a microphone 1, whereby the speech is converted into an speech signal as an electrical signal, and the signal is supplied to an A/D (Analog/Digital) conversion section 2. The A/D conversion section 2 samples an analog speech signal from the microphone 1, for example, at a sampling frequency of 8 kHz, etc., so that the analog speech signal undergoes A/D conversion from an analog signal into a digital speech signal. Furthermore, the A/D conversion section 2 performs quantization of the signal with a predetermined number of bits and supplies the signal to an arithmetic unit 3 and an LPC (Linear Prediction Coefficient) analysis section 4.

The LPC analysis section 4 assumes a length, for example, of 160 samples of an speech signal from the A/D conversion section 2 to be one frame, divides that frame into subframes every 40 samples, and performs LPC analysis for each subframe in order to determine linear predictive coefficients $\alpha_1$, $\alpha_2$, . . . $\alpha_p$ of the P order. Then, the LPC analysis section 4 assumes a vector in which these linear predictive coefficient $\alpha_p$ (p=1, 2, . . . , P) of the P order are elements, as a speech feature vector, to a vector quantization section 5.

The vector quantization section 5 stores a codebook in which a code vector having linear predictive coefficients as elements corresponds to codes, performs vector quantization on a feature vector $\alpha$ from the LPC analysis section 4 on the basis of the codebook, and supplies the codes (hereinafter referred to as an "A_code" as appropriate) obtained as a result of the vector quantization to a code determination section 15.

Furthermore, the vector quantization section 5 supplies linear predictive coefficients $\alpha_1'$, $\alpha_2'$, . . . , $\alpha_p'$, which are elements forming a code vector $\alpha'$ corresponding to the A_code, to a speech synthesis filter 6.

The speech synthesis filter 6 is, for example, an IIR (Infinite Impulse Response) type digital filter, which assumes a linear predictive coefficient $\alpha_p'$ (p=1, 2, . . . , P) from the vector quantization section 5 to be a tap coefficient of the IIR filter and assumes a residual signal e supplied from an arithmetic unit 14 to be an input signal, to perform speech synthesis.

More specifically, LPC analysis performed by the LPC analysis section 4 is such that, for the (sample value) $s_n$ of the speech signal at the current time n and past P sample values $s_{n-1}$, $s_{n--2}$, . . . , $s_{n-p}$ adjacent to the above sample value, a linear combination represented by the following equation holds:

$$s_n+\alpha_1 s_{n-1}+\alpha_2 s_{n-2}+\ldots+\alpha_p s_{n-p}=e_n \tag{1}$$

and when linear prediction of a prediction value (linear prediction value) $s_n'$ of the sample value $s_n$ at the current time n is performed using the past P sample values $s_{n--1}$, $s_{n-2}$, . . . , $s_{n-p}$ on the basis of the following equation:

$$s_n'=-(\alpha_1 s_{n-1}+\alpha_2 s_{n-2}+\ldots+\alpha_p s_{n-p}) \tag{2}$$

a linear predictive coefficient $\alpha_p$ that minimizes the square error between the actual sample value $s_n$ and the linear prediction value $s_n'$ is determined.

Here, in equation (1), $\{e_n\}$ ( . . . , $e_{n-1}$, $e_n$, $e_{n+1}$, . . . ) are probability variables, which are uncorrelated with each other, in which the average value is 0 and the variance is a predetermined value $\sigma^2$.

Based on equation (1), the sample value $s_n$ can be expressed by the following equation:

$$s_n=e_n-(\alpha_1 s_{n-1}+\alpha_2 s_{n-2}+\ldots+\alpha_p s_{n-p}) \tag{3}$$

When this is subjected to Z-transformation, the following equation is obtained:

$$S=E/(1+\alpha_1 z^{-1}+\alpha_2 z^{-2}+\ldots+\alpha_p z^{-p}) \tag{4}$$

where, in equation (4), S and E represent Z-transformation of $s_n$ and $e_n$ in equation (3), respectively.

Here, based on equations (1) and (2), $e_n$ can be expressed by the following equation:

$$e_n=s_n-s_n' \tag{5}$$

and this is called the "residual signal" between the actual sample value $s_n$ and the linear prediction value $s_n'$.

Therefore, based on equation (4), the speech signal $s_n$ can be determined by assuming the linear predictive coefficient $\alpha_p$ to be a tap coefficient of the IIR filter and by assuming the residual signal $e_n$ to be an input signal of the IIR filter.

Therefore, as described above, the speech synthesis filter 6 assumes the linear predictive coefficient $\alpha_p'$ from the vector quantization section 5 to be a tap coefficient, assumes the residual signal e supplied from the arithmetic unit 14 to be an input signal, and computes equation (4) in order to determine an speech signal (synthesized speech data) ss.

In the speech synthesis filter 6, since a linear predictive coefficient $\alpha_p'$ as a code vector corresponding to the code obtained as a result of the vector quantization is used instead of the linear predictive coefficient $\alpha_p$ obtained as a result of the LPC analysis by the LPC analysis section 4, that is, since a linear prediction coefficient $\alpha'$ containing an quantization error is used, basically, the synthesized speech signal output from the speech synthesis filter 6 does not become the same as the speech signal output from the A/D conversion section 2.

The synthesized speech signal ss output from the speech synthesis filter 6 is supplied to the arithmetic unit 3. The arithmetic unit 3 subtracts an speech signal s output by the A/D conversion section 2 from the synthesized speech data ss from the speech synthesis filter 6 (subtracts the sample of the speech data s corresponding to that sample from each sample of the synthesized speech data ss), and supplies the subtracted value to a square-error computation section 7. The A/D conversion section 7 computes the sum of squares (sum of squares in units of subframes which form the frame in which LPC analysis is performed by the LPC analysis section 4) of the subtracted value from the arithmetic unit 3 and supplies the resulting square error to a least-square error determination section 8.

The least-square error determination section 8 has stored therein an L code (L_code) as a code indicating a lag, a G code (G_code) as a code indicating a gain, and an I code (I_code) as a code indicating a codeword (excitation codebook) in such a manner as to correspond to the square error output from the square-error computation section 7, and outputs the L_code, the G code, and the L code corresponding to the square error output from the square-error computation section 7. The L code is supplied to an adaptive codebook storage section 9. The G code is supplied to a gain decoder 10. The I code is supplied to an excitation-codebook storage section 11. Furthermore, the L code, the G code, and the I code are also supplied to the code determination section 15.

The adaptive codebook storage section 9 has stored therein an adaptive codebook in which, for example, a 7-bit L code corresponds to a predetermined delay time (long-term prediction lag). The adaptive codebook storage section 9 delays the residual signal e supplied from the arithmetic unit 14 by a delay time corresponding to the L code supplied from the least-square error determination section 8 and outputs the signal to an arithmetic unit 12. That is, the adaptive codebook storage section 9 is formed of, for example, memory, and delays the residual signal e from the arithmetic unit 14 by the amount of samples corresponding to the value indicated by the 7-bit record and outputs the signal to the arithmetic unit 12.

Here, since the adaptive codebook storage section 9 delays the residual signal e by a time corresponding to the L code and outputs the signal, the output signal becomes a signal close to a period signal in which the delay time is a period. This signal becomes mainly a driving signal for generating synthesized speech of voiced sound in speech synthesis using linear predictive coefficients.

A gain decoder 10 has stored therein a table in which the G code corresponds to predetermined gains β and γ, and outputs gains β and γ corresponding to the G code supplied from the least-square error determination section 8. The gains β and γ are supplied to the arithmetic units 12 and 13, respectively. Here, the gain β is what is commonly called a long-term filter status output gain, and the gain γ is what is commonly called an excitation codebook gain.

The excitation-codebook storage section 11 has stored therein an excitation codebook in which, for example, a 9-bit I code corresponds to a predetermined excitation signal, and outputs, to the arithmetic unit 13, the excitation signal which corresponds to the I code supplied from the least-square error determination section 8.

Here, the excitation signal stored in the excitation codebook is, for example, a signal close to white noise, and becomes mainly a driving signal for generating synthesized speech of unvoiced sound in the speech synthesis using linear predictive coefficients.

The arithmetic unit 12 multiplies the output signal of the adaptive codebook storage section 9 with the gain β output from the gain decoder 10 and supplies the multiplied value 1 to the arithmetic unit 14. The arithmetic unit 13 multiplies the output signal of the excited codebook storage section 11 with the gain γ output from the gain decoder 10 and supplies the multiplied value n to the arithmetic unit 14. The arithmetic unit 14 adds together the multiplied value 1 from the arithmetic unit 12 with the multiplied value n from the arithmetic unit 13, and supplies the added value as the residual signal e to the speech synthesis filter 6 and the adaptive codebook storage section 9.

In the speech synthesis filter 6, in the manner described above, the residual signal e supplied from the arithmetic unit 14 is filtered by the IIR filter in which the linear predictive coefficient $\alpha_p'$ supplied from the vector quantization section 5 is a tap coefficient, and the resulting synthesized speech data is supplied to the arithmetic unit 3. Then, in the arithmetic unit 3 and the square-error computation section 7, processes similar to the above-described case are performed, and the resulting square error is supplied to the least-square error determination section 8.

The least-square error determination section 8 determines whether or not the square error from the square-error computation section 7 has become a minimum (local minimum). Then, when the least-square error determination section 8 determines that the square error has not become a minimum, the least-square error determination section 8 outputs the L code, the G code, and the I code corresponding to the square error in the manner described above, and hereafter, the same processes are repeated.

On the other hand, when the least-square error determination section 8 determines that the square error has become a minimum, the least-square error determination section 8 outputs the determination signal to the code determination section 15. The code determination section 15 sequentially latches the A code supplied from the vector quantization section 5 and sequentially latches the L code, the G code, and the I code supplied from the least-square error determination section 8. When the determination signal is received from the least-square error determination section 8, the code determination section 15 supplies the A code, the L code, the G code, and the I code, which are latched at this time, to the channel encoder 16. The channel encoder 16 multiplexes the A code, the L code, the G code, and the I code from the code determination section 15 and outputs them as code data. This code data is transmitted via a transmission path.

Based on the above, the code data is coded data having the A code, the L code, the G code, and the I code, which are information used for decoding, in units of subframes.

Here, the A code, the L code, the G code, and the I code are determined for each subframe. However, for example, there is a case in which the A code is sometimes determined for each frame. In this case, to decode the four subframes which form that frame, the same A code is used. However, also, in this case, each of the four subframes which form that one frame can be regarded as having the same A code. In this way, the code data can be regarded as being formed as coded data having the A code, the L code, the G code, and the I code, which are information used for decoding, in units of subframes.

Here, in FIG. 1 (the same applies also in FIGS. 2, 5, and 13, which will be described later), [k] is assigned to each variable so that the variable is an array variable. This k represents the number of subframes, but in the specification, a description thereof is omitted where appropriate.

Next, the code data transmitted from the transmission section of another mobile phone in the above-described manner is received by a channel decoder 21 of the receiving section shown in FIG. 2. The channel decoder 21 separates the L code, the G code, the I code, and the A code from the code data, and supplies each of them to an adaptive codebook storage section 22, a gain decoder 23, an excitation codebook storage section 24, and a filter coefficient decoder 25.

The adaptive codebook storage section 22, the gain decoder 23, the excitation codebook storage section 24, and arithmetic units 26 to 28 are formed similarly to the adaptive codebook storage section 9, the gain decoder 10, the excited codebook storage section 11, and the arithmetic units 12 to 14 of FIG. 1, respectively. As a result of the same processes as in the case described with reference to FIG. 1 being performed, the L code, the G code, and the I code are decoded into the residual signal e. This residual signal e is provided as an input signal to a speech synthesis filter 29.

The filter coefficient decoder 25 has stored therein the same codebook as that stored in the vector quantization section 5 of FIG. 1, so that the A code is decoded into a linear predictive coefficient $\alpha_p'$ and this is supplied to the speech synthesis filter 29.

The speech synthesis filter 29 is formed similarly to the speech synthesis filter 6 of FIG. 1. The speech synthesis filter 29 assumes the linear predictive coefficient $\alpha_p'$ from the filter coefficient decoder 25 to be a tap coefficient, assumes the residual signal e supplied from an arithmetic unit 28 to be an input signal, and computes equation (4), thereby generating synthesized speech data when the square error is determined to be a minimum in the least-square error determination section 8 of FIG. 1. This synthesized speech data is supplied to a D/A (Digital/Analog) conversion section 30. The D/A conversion section 30 subjects the synthesized speech data from the speech synthesis filter 29 to D/A conversion from a digital signal into an analog signal, and supplies the analog signal to a speaker 31, whereby the signal is output.

In the code data, when the A codes are arranged in frame units rather than in subframe units, in the receiving section of FIG. 2, linear predictive coefficients corresponding to the A codes arranged in that frame can be used to decode all four subframes which form the frame. In addition, interpolation is performed on each subframe by using the linear predictive coefficients corresponding to the A code of the adjacent frame, and the linear predictive coefficients obtained as a result of the interpolation can be used to decode each subframe.

As described above, in the transmission section of the mobile phone, since the residual signal and linear predictive coefficients, as file data provided to the speech synthesis filter 29 of the receiving section, are coded and then transmitted, in the receiving section, the codes are decoded into a residual signal and linear predictive coefficients. However, since the decoded residual signal and linear predictive coefficients (hereinafter referred to as "decoded residual signal and decoded linear predictive coefficients", respectively, as appropriate) contain errors such as quantization errors, these do not match the residual signal and the linear predictive coefficients obtained by performing LPC analysis on speech.

For this reason, the synthesized speech signal output from the speech synthesis filter 29 of the receiving section becomes deteriorated sound quality in which distortion is contained.

DISCLOSURE OF THE INVENTION

The present invention has been made in view of such circumstances, and aims to obtain high-quality synthesized speech, etc.

A first data processing apparatus of the present invention comprises: tap generation means for generating a tap used for a predetermined process by extracting the decoded data in a predetermined positional relationship with subject data of interest within the decoded data such that the coded data is decoded and by extracting the decoding information in predetermined units according to the position of the subject data in the predetermined units; and processing means for performing a predetermined process by using the tap.

A first data processing method of the present invention comprises: a tap generation step of generating a tap used for a predetermined process by extracting the decoded data in a predetermined positional relationship with subject data of interest within the decoded data such that the coded data is decoded and by extracting the decoding information in predetermined units according to the position of the subject data in the predetermined units; and a processing step of performing a predetermined process by using the tap.

A first program comprises: a tap generation step of generating a tap used for a predetermined process by extracting the decoded data in a predetermined positional relationship with subject data of interest within the decoded data such that the coded data is decoded and by extracting the decoding information in predetermined units according to the position of the subject data in the predetermined units; and a processing step of performing a predetermined process by using the tap.

A first recording medium having recorded thereon a program comprises: a tap generation step of generating a tap used for a predetermined process by extracting the decoded data in a predetermined positional relationship with subject data of interest within the decoded data such that the coded data is decoded and by extracting the decoding information in predetermined units according to the position of the subject data in the predetermined units; and a processing step of performing a predetermined process by using the tap.

A second data processing apparatus of the present invention comprises: student data generation means for generating decoded data as student data serving as a student by coding teacher serving as a teacher into the coded data having decoding information in predetermined units and by decoding the coded data; prediction tap generation means for generating a prediction tap used to predict teacher data by extracting the decoded data in a predetermined positional relationship with subject data of interest within the decoded data as the student data and by extracting the decoding information in the predetermined units according to a position of the subject data in the predetermined units; and learning means for performing learning so that a prediction error of the prediction value of the teacher data obtained by performing a predetermined prediction computation by using the prediction tap and the tap coefficient statistically becomes a minimum, and for determining the tap coefficient.

A second data processing method of the present invention comprises: a student data generation step of generating decoded data as student data serving as a student by coding teacher serving as a teacher into coded data having the decoding information in predetermined units and by decoding the coded data; a prediction tap generation step of generating a prediction tap used to predict teacher data by extracting the decoded data in a predetermined positional relationship with subject data of interest within the decoded data as the student data and by extracting the decoding information in the predetermined units according to a position of the subject data in the predetermined units; and a learning step of performing learning so that a prediction error of the prediction value of the teacher data obtained by performing a predetermined prediction computation by using the prediction tap and the tap coefficient statistically becomes a minimum, and for determining the tap coefficient.

A second program comprises: a student data generation step of generating decoded data as student data serving as a student by coding teacher serving as a teacher into coded data having the decoding information in predetermined units and by decoding the coded data; a prediction tap generation step of generating a prediction tap used to predict teacher data by extracting the decoded data in a predetermined positional relationship with subject data of interest within the decoded data as the student data and by extracting the decoding information in the predetermined units according to a position of the subject data in the predetermined units; and a learning step of performing learning so that a prediction error of the prediction value of the teacher data, obtained by performing a predetermined prediction computation by using the prediction tap and the tap coefficient statistically becomes a minimum, and for determining the tap coefficient.

A second recording medium having recorded thereon a program comprising: a student data generation step of generating decoded data as student data serving as a student by coding teacher serving as a teacher into coded data having the decoding information in predetermined units and by decoding the coded data; a prediction tap generation step of generating a prediction tap used to predict teacher data by extracting the decoded data in a predetermined positional relationship with subject data of interest within the decoded data as the student data and by extracting the decoding information in the predetermined units according to a position of the subject data in the predetermined units; and a learning step of performing learning so that a prediction error of the prediction value of the teacher data obtained by performing a predetermined prediction computation by using the prediction tap and the tap coefficient statistically becomes a minimum, and for determining the tap coefficient In the first data processing apparatus, the first data processing method, the first program, and the first recording medium of the present invention, decoded data in a predetermined positional relationship with subject data of interest within decoded data such that coded data is decoded is extracted, and decoding information in predetermined units is extracted according to a position of the subject data in the predetermined units, thereby generating a tap for a predetermined process, and a predetermined process is performed by using the tap.

In the second data processing apparatus, the second data processing method, the second program, and the second recording medium of the present invention, decoded data as student data serving as a student is generated by coding teacher data serving as a teacher into THE coded data having decoding information in predetermined units and by decoding the coded data. Furthermore, a prediction tap used to predict teacher data is generated by extracting the decoded data in a predetermined positional relationship with subject data of interest within the decoded data as the student data and by extracting the decoding information in the predetermined units according to a position of the subject data in the predetermined units. Then, learning is performed so that a prediction error of the prediction value of the teacher data obtained by performing a predetermined prediction computation by using the prediction tap and a tap coefficient statistically becomes a minimum, and the tap coefficient is determined.

BRIEF DESCRIPTION OF THE DRAWINGS

FIGS. 10A and 10B illustrate a method of weighting with respect to a class by an I code.

BEST MODE FOR CARRYING OUT THE INVENTION

Figure 3:
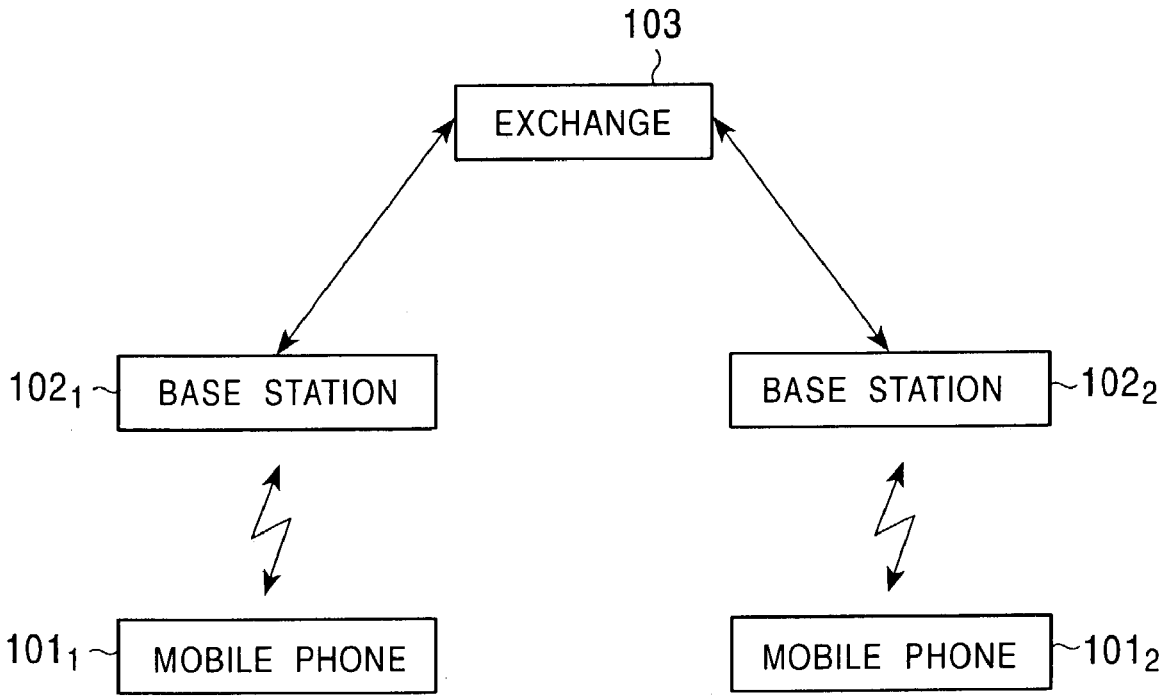
FIG. 3 is a block diagram showing an example of the configuration of an embodiment of a transmission system according to the present invention.

FIG. 3 shows the configuration of one embodiment of a transmission system ("system" refers to a logical assembly of a plurality of apparatuses, and it does not matter whether or not the apparatus of each configuration is in the same housing) to which the present invention is applied.

In this transmission system, mobile phones $\mathbf{101}_1$ and $\mathbf{101}_2$ perform wireless transmission and reception with base stations $\mathbf{102}_1$ and $\mathbf{102}_2$, respectively, and each of the base stations $\mathbf{102}_1$ and $\mathbf{102}_2$ performs transmission and reception with an exchange station 103, so that, finally, speech transmission and reception can be performed between the mobile phones $\mathbf{101}_1$ and $\mathbf{101}_2$ via the base stations $\mathbf{102}_1$ and $\mathbf{102}_2$ and the exchange station 103. The base stations $\mathbf{102}_1$ and $\mathbf{102}_2$ may be the same base station or different base stations.

Hereinafter, the mobile phones $\mathbf{101}_1$ and $\mathbf{101}_2$ will be described as a "mobile phone 101" unless it is not particularly necessary to be identified.

Figure 4:
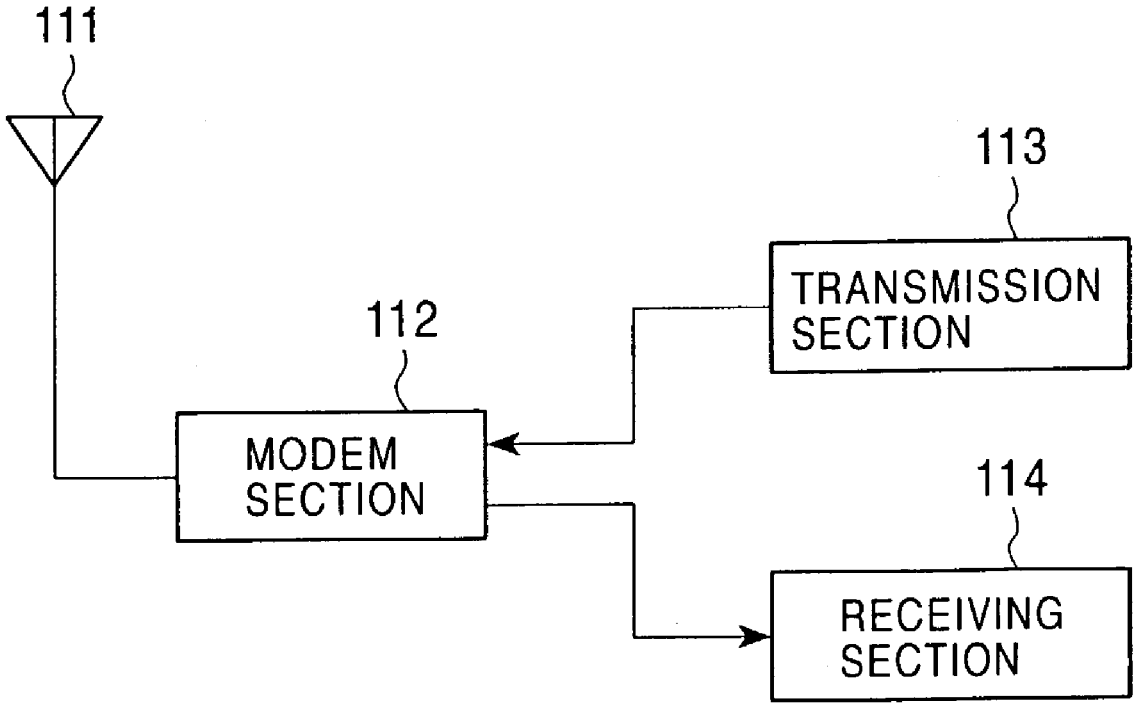
FIG. 4 is a block diagram showing an example of the configuration of mobile phones 1011 and 1012.

Next, FIG. 4 shows an example of the configuration of the mobile phone 101 of FIG. 3.

In this mobile phone 101, speech transmission and reception is performed in accordance with a CELP method.

More specifically, an antenna 111 receives radio waves from the base station $\mathbf{102}_1$ or $\mathbf{102}_2$, supplies the received signal to a modem section 112, and transmits the signal from the modem section 112 to the base station $\mathbf{102}_1$ or $\mathbf{102}_2$ in the form of radio waves. The modem section 112 demodulates the signal from the antenna 111 and supplies the resulting code data, such as that described in FIG. 1, to the receiving section 114. Furthermore, the modem section 112 modulates code data, such as that described in FIG. 1, supplied from the transmission section 113, and supplies the resulting modulation signal to the antenna 111. The transmission section 113 is formed similarly to the transmission section shown in FIG. 1, codes the speech of the user, input thereto, into code data by a CELP method, and supplies the data to the modem section 112. The receiving section 114 receives the code data from the modem section 112, decodes the code data by the CELP method, and decodes high-quality sound and outputs it.

More specifically, in the receiving section 114, synthesized speech decoded by the CELP method using, for example, a classification and adaptation process is further decoded into (the prediction value of) true high-quality sound.

Here, the classification and adaptation process is formed of a classification process and an adaptation process, so that data is classified according to the properties thereof by the classification process, and an adaptation process is performed for each class. The adaptation process is such as that described below.

That is, in the adaptation process, for example, a prediction value of true high-quality sound is determined by linear combination of synthesized speech decoded by a CELP method and a predetermined tap coefficient.

Figure 2:
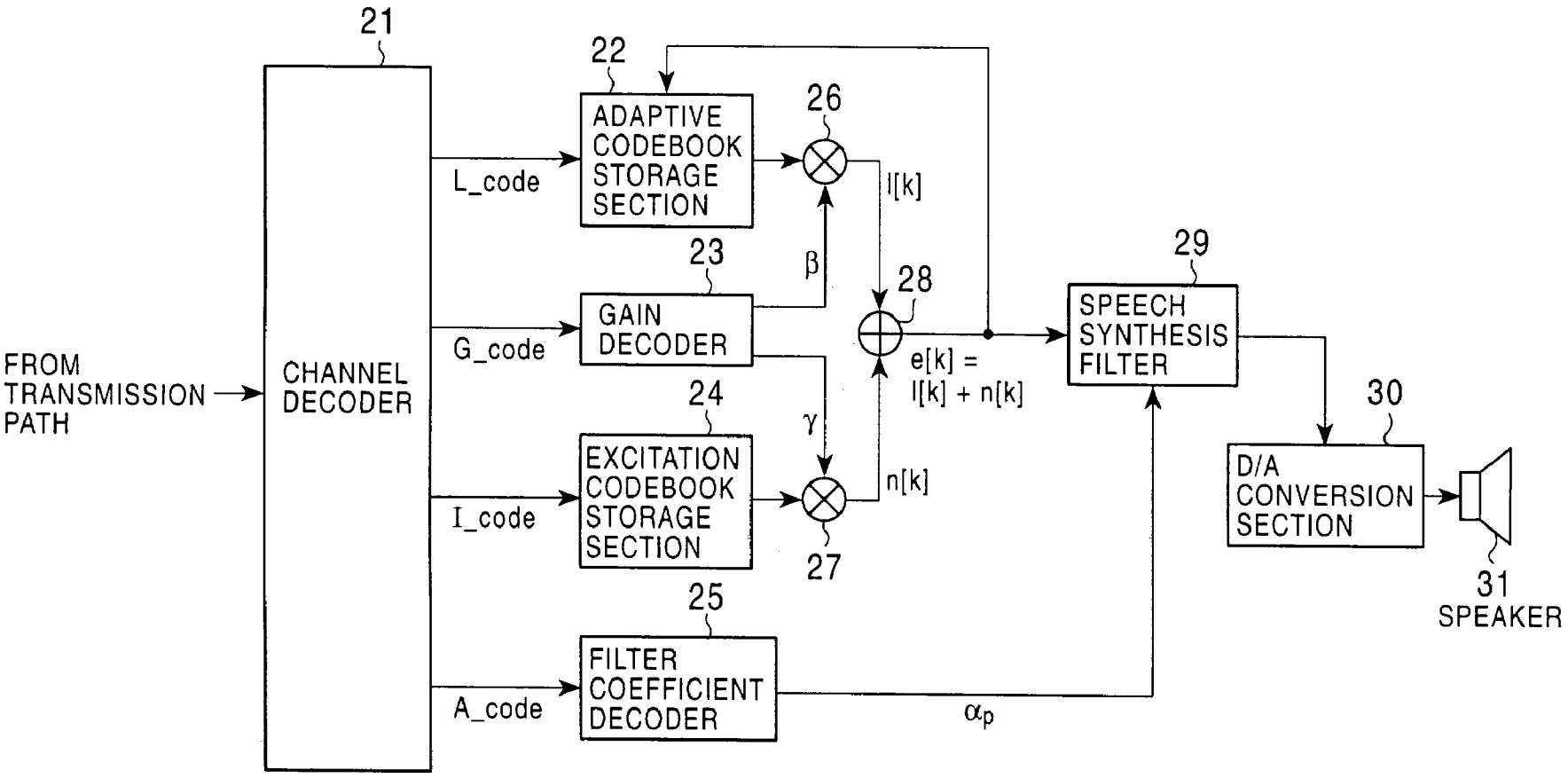
FIG. 2 is a block diagram showing the configuration of an example of a receiving section of a conventional mobile phone.

More specifically, it is considered that, for example, (the sample value of) true high-quality sound is assumed to be teacher data, and the synthesized speech obtained in such a way that the true high-quality sound is coded into an L code, a G code, an I code, and an A code by the CELP method and these codes are decoded by the receiving section shown in FIG. 2 is assumed to be student data, and that a prediction value E[y] of high-quality sound y which is teacher data is determined by a linear first-order combination model defined by a linear combination of a set of several (sample values of) synthesized speeches $x_1, x_2, \ldots$ and predetermined tap coefficients $w_1, w_2, \ldots$ In this case, the prediction value E[y] can be expressed by the following equation:

$$E[y]=w_1x_1+w_2x_2, \ldots \tag{6}$$

To generalize equation (1), when a matrix W is composed of a set of tap coefficients $w_j$, a matrix X composed of a set of student data $x_{ij}$ and a matrix Y' composed of prediction values $E[y_j]$ are defined by the following:

[Equation 1]

$$X = \begin{bmatrix} x_{11} & x_{12} & \cdots & x_{1J} \\ x_{21} & x_{22} & \cdots & x_{2J} \\ \cdots & \cdots & \cdots & \cdots \\ x_{I1} & x_{I2} & \cdots & x_{IJ} \end{bmatrix}$$

$$W = \begin{bmatrix} W_1 \\ W_2 \\ \cdots \\ W_J \end{bmatrix}, Y' = \begin{bmatrix} E[y_1] \\ E[y_2] \\ \cdots \\ E[y_I] \end{bmatrix}$$

the following observation equations holds:

$$XW=Y' \tag{7}$$

where the component $x_{ij}$ of the matrix X means the j-th student data within the set of the i-th student data (the set of student data used to predict the i-th teacher data $y_i$), and the component $w_j$ of the matrix W indicates a tap coefficient with which the product with the j-th student data within the set of student data is computed. Furthermore, $y_i$ indicates the i-th teacher data, and therefore, $E[y_i]$ indicates the prediction value of the i-th teacher data. y on the left side of equation (6) is such that the suffix i of the component $y_i$ of the matrix Y is omitted. Furthermore, $x_1, x_2, \ldots$ on the right side of equation (6) are such that the suffix i of the component $x_{ij}$ of the matrix X is omitted.

Then, it is considered that a least-square method is applied to this observation equation in order to determine a prediction value E[y] close to the true high-quality sound y. In this case, when the matrix Y composed of a set of sounds y of true high sound quality, which becomes teacher data, and a matrix E composed of a set of residuals e of the prediction value E[y] with respect to the high-quality sound y are defined by the following:

[Equation 2]

$$E = \begin{bmatrix} e_1 \\ e_2 \\ \cdots \\ e_I \end{bmatrix}, Y = \begin{bmatrix} y_1 \\ y_2 \\ \cdots \\ y_I \end{bmatrix}$$

the following residual equation holds on the basis of equation (7):

$$XW=Y+E \tag{8}$$

In this case, the tap coefficient $w_j$ for determining the prediction value E[y] close to the true speech y of high sound quality can be determined by minimizing the square error:

[Equation 3]

$$\sum_{i=1}^{I} e_i^2$$

Therefore, when the above-described square error differentiated by the tap coefficient $w_j$ becomes 0, it follows that the tap coefficient $w_j$ that satisfies the following equation will be the optimum value for determining the prediction value E[y] close to the true speech y of high sound quality.

[Equation 4]

$$e_1\frac{\partial e_1}{\partial w_j} + e_2\frac{\partial e_2}{\partial w_2} + \ldots + e_I\frac{\partial e_I}{\partial w_j} = 0 \quad (j = 1, 2, \ldots, J) \tag{9}$$

Accordingly, first, by differentiating equation (8) with the tap coefficient $w_j$, the following equations hold:

[Equation 5]

$$\frac{\partial e_i}{\partial w_1} = x_{i1}, \frac{\partial e_i}{\partial w_2} = x_{i2}, \ldots, \frac{\partial e_i}{\partial w_J} = x_{iJ}, (i = 1, 2, \ldots, I) \tag{10}$$

Equations (11) are obtained on the basis of equations (9) and (10):

[Equation 6]

$$\sum_{i=1}^{I} e_i x_{i1} = 0, \sum_{i=1}^{I} e_i x_{i2} = 0, \ldots \sum_{i=1}^{I} e_i x_{iJ} = 0 \tag{11}$$

Furthermore, when the relationships among the student data $x_{ij}$, the tap coefficient $w_j$, the teacher data $y_i$, and the error $e_i$ in the residual equation of equation (8) are taken into consideration, the following normalization equations can be obtained on the basis of equations (11):

[Equation 7]

$$\begin{cases} \left(\sum_{i=1}^{l} X_{i1}X_{i1}\right)W_1 + \left(\sum_{i=1}^{l} X_{i1}X_{i2}\right)W_2 + \ldots + \left(\sum_{i=1}^{l} X_{i1}X_{iJ}\right)W_J = \left(\sum_{i=1}^{l} X_{i1}y_i\right) \\ \left(\sum_{i=1}^{l} X_{i2}X_{i1}\right)W_1 + \left(\sum_{i=1}^{l} X_{i2}X_{i2}\right)W_2 + \ldots + \left(\sum_{i=1}^{l} X_{i2}X_{iJ}\right)W_J = \left(\sum_{i=1}^{l} X_{i2}y_i\right) \\ \ldots \\ \left(\sum_{i=1}^{l} X_{iJ}X_{i1}\right)W_1 + \left(\sum_{i=1}^{l} X_{iJ}X_{i2}\right)W_2 + \ldots + \left(\sum_{i=1}^{l} X_{iJ}X_{iJ}\right)W_J = \left(\sum_{i=1}^{l} X_{iJ}y_i\right) \end{cases} \quad (12)$$

When the matrix (covariance matrix) A and a vector v are defined on the basis of:

[Equation 8]

$$A = \begin{pmatrix} \sum_{i=1}^{l} x_{i1}x_{i1} & \sum_{i=1}^{l} x_{i1}x_{i2} & \ldots & \sum_{i=1}^{l} x_{i1}x_{iJ} \\ \sum_{i=1}^{l} x_{i2}x_{i1} & \sum_{i=1}^{l} x_{i2}x_{i2} & \ldots & \sum_{i=1}^{l} x_{i2}x_{iJ} \\ & & \ldots & \\ \sum_{i=1}^{l} x_{iJ}x_{i1} & \sum_{i=1}^{l} x_{iJ}x_{i2} & \ldots & \sum_{i=1}^{l} X_{iJ}X_{iJ} \end{pmatrix}$$

$$v = \begin{pmatrix} \sum_{i=1}^{l} x_{i1}y_i \\ \sum_{i=1}^{l} x_{i2}y_i \\ \ldots \\ \sum_{i=1}^{l} x_{iJ}y_i \end{pmatrix}$$

and when a vector W is defined as shown in equation 1, the normalization equation shown in equations (12) can be expressed by the following equation:

$$AW=v \quad (13)$$

Each normalization equation in equation (12) can be formulated by the same number as the number J of the tap coefficient $w_j$ to be determined by preparing the set of the student data $x_{ij}$ and the teacher data $y_i$ by a certain degree of number. Therefore, solving equation (13) with respect to the vector W (however, to solve equation (13), it is required that the matrix A in equation (13) be regular) enables the optimum tap coefficient (here, a tap coefficient that minimizes the square error) $w_j$ to be determined. When solving equation (13), for example, a sweeping-out method (Gauss-Jordan's elimination method), etc., can be used.

The adaptation process determines, in the above-described manner, the optimum tap coefficient $w_j$ in advance, and the tap coefficient $w_j$ is used to determine, based on equation (6), the predictive value E[y] close to the true high-quality sound y.

For example, in a case where, as the teacher data, an speech signal which is sampled at a high sampling frequency or an speech signal to which many bits are assigned is used, and as the student data, synthesized speech obtained in such a way that the speech signal as the teacher data is thinned or an speech signal which is requantized with a small number of bits is coded by the CELP method and the coded result is decoded is used, regarding the tap coefficient, when an speech signal which is sampled at a high sampling frequency or an speech signal to which many bits are assigned is to be generated, high-quality sound in which the prediction error statistically becomes a minimum is obtained. Therefore, in this case, it is possible to obtain higher-quality synthesized speech.

In the receiving section 114 of FIG. 4, the classification and adaptation process such as that described above decodes the synthesized speech obtained by decoding code data by a CELP method into higher-quality sound.

Figure 5:
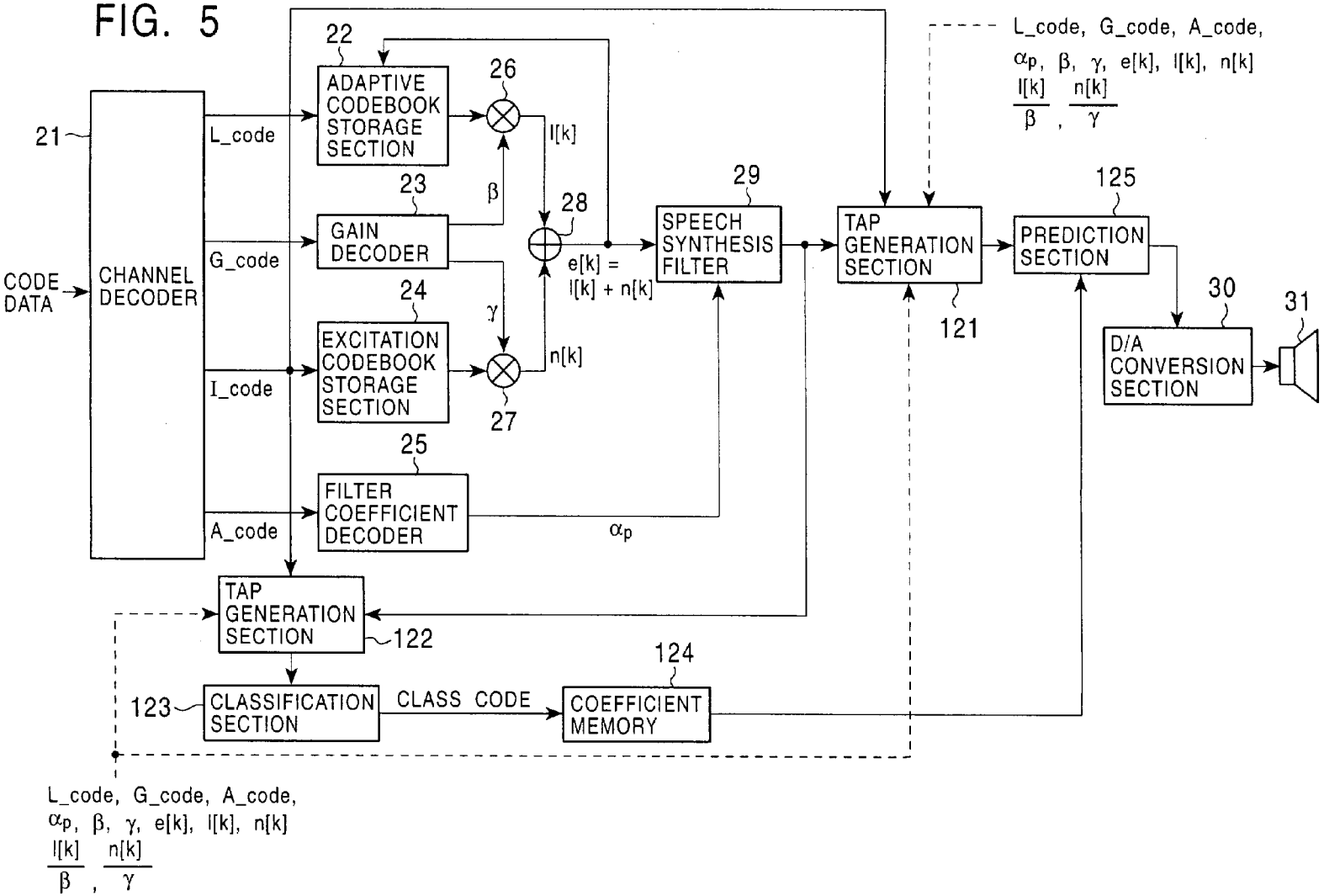
FIG. 5 is a block diagram showing an example of the configuration of a receiving section 114.

More specifically, FIG. 5 shows an example of the configuration of the receiving section 114 of FIG. 4. Components in FIG. 5 corresponding to the case in FIG. 2 are given the same reference numerals, and in the following, descriptions thereof are omitted where appropriate.

Synthesized speech data for each subframe, which is output from the speech synthesis filter 29, and the L code among the L code, the G code, the I code, and the A code for each subframe, which are output from the channel decoder 21, are supplied to the tap generation sections 121 and 122. The tap generation sections 121 and 122 extract data used as a prediction tap used to predict the prediction value of high-quality sound and data used as a class tap used for classification from the synthesized speech data and the I code supplied to the tap generation sections 121 and 122, respectively. The prediction tap is supplied to a prediction section 125, and the class tap is supplied to a classification section 123.

The classification section 123 performs classification on the basis of the class tap supplied from the tap generation section 122, and supplies the class code as the classification result to a coefficient memory 124.

Here, as a classification method in the classification section 123, there is a method using, for example, a K-bit ADRC (Adaptive Dynamic Range Coding) process.

Here, in the K-bit ADRC process, for example, a maximum value MAX and a minimum value MIN of the data forming the class tap are detected, and DR=MAX−MIN is assumed to be a local dynamic range of a set. Based on this dynamic range DR, each piece of data which forms the class tap is requantized to K bits. That is, the minimum value MIN is subtracted from each piece of data which forms the class tap, and the subtracted value is divided (quantized) by $DR/2^K$. Then, a bit sequence in which the values of the K bits of each piece of data which forms the class tap are arranged in a predetermined order is output as an ADRC code.

When such a K-bit ADRC process is used for classification, for example, a bit sequence in which the values of the K-bit of each of data which forms a prediction tap obtained as a result of the K-bit ADRC process are arranged in a predetermined order is assumed to be a class code.

In addition, for example, the classification can also be performed by considering a class tap as a vector in which each piece of data which forms the class tap is an element and by performing vector quantization on the class tap as the vector.

The coefficient memory 124 stores tap coefficients for each class, obtained as a result of a learning process being performed in the learning apparatus of FIG. 13, which will be described later, and supplies to the prediction section 125 a tap coefficient stored at the address corresponding to the class code output from the classification section 123.

The prediction section 125 obtains the prediction tap output from the tap generation section 121 and the tap coefficient output from the coefficient memory 124, and performs the linear prediction computation shown in equation (6) by using the prediction tap and the tap coefficient. As a result, the prediction section 125 determines (the prediction value of the) high-quality sound with respect to the subject subframe of interest and supplies the value to the D/A conversion section 30.

Figure 6:
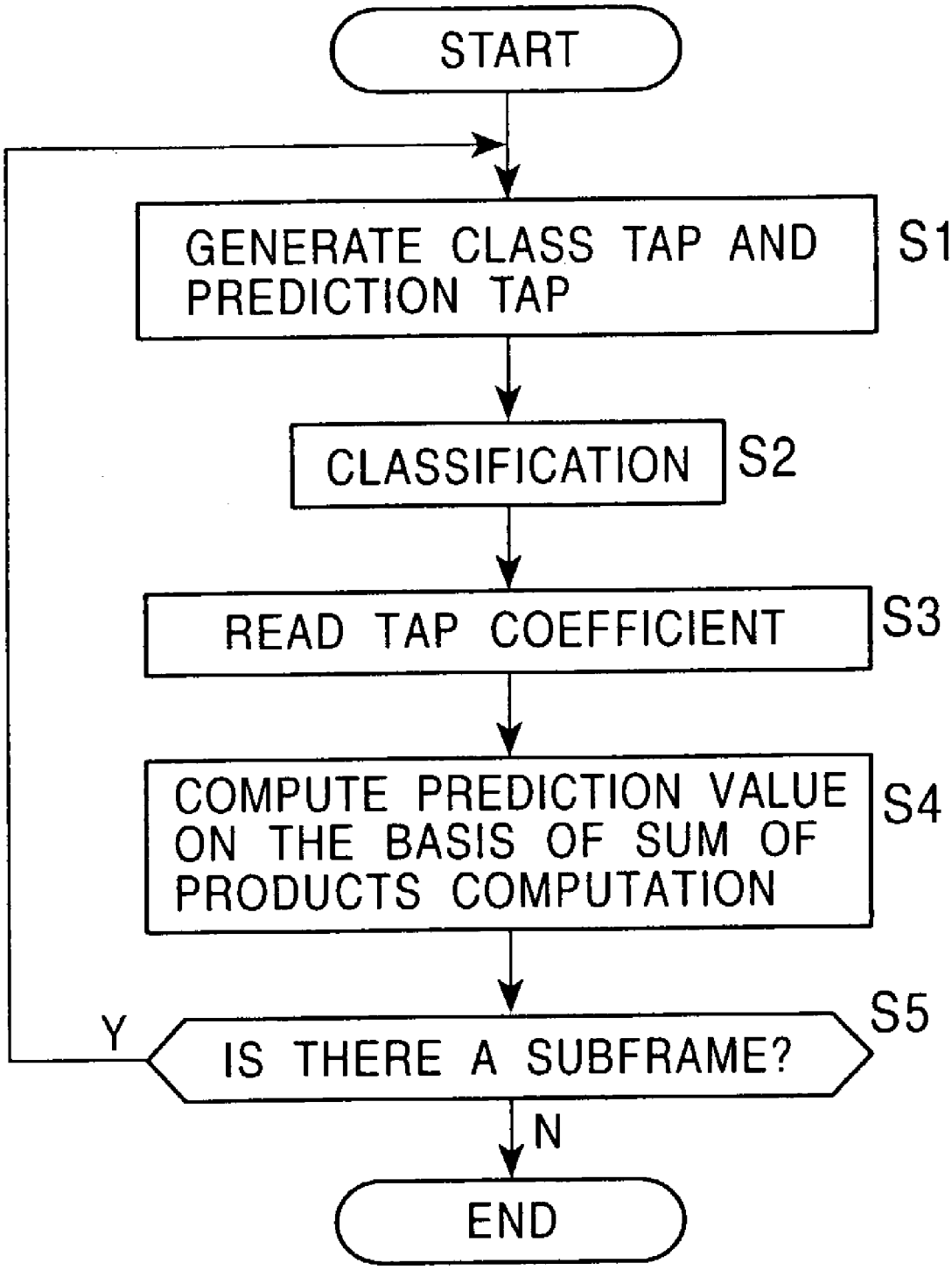
FIG. 6 is a flowchart illustrating processes of the receiving section 114.

Next, referring to the flowchart in FIG. 6, a description is given of a process of the receiving section 114 of FIG. 5.

The channel decoder 21 separates an L code, a G code, an I code, and an A code from the code data supplied thereto, and supplies the codes to the adaptive codebook storage section 22, the gain decoder 23, the excitation codebook storage section 24, and the filter coefficient decoder 25, respectively. Furthermore, the L code is also supplied to the tap generation sections 121 and 122.

Then, the adaptive codebook storage section 22, the gain decoder 23, the excitation codebook storage section 24, and arithmetic units 26 to 28 perform the same processes as in the case of FIG. 2, and as a result, the L code, the G code, and the I code are decoded into a residual signal e. This residual signal is supplied to the speech synthesis filter 29.

Furthermore, as described with reference to FIG. 2, the filter coefficient decoder 25 decodes the A code supplied thereto into a linear prediction coefficient and supplies it to the speech synthesis filter 29. The speech synthesis filter 29 performs speech synthesis by using the residual signal from the arithmetic unit 28 and the linear prediction coefficient from the filter coefficient decoder 25, and supplies the resulting synthesized speech to the tap generation sections 121 and 122.

The tap generation section 121 assumes the subframe of the synthesized speech which is output in sequence by the speech synthesis filter 29 to be a subject subframe in sequence. In step S1, the tap generation section 121 generates a prediction tap from the synthesized speech of the subject subframe and the I code of the subframe, which will be described later, and supplies the prediction tap to the prediction section 125. Furthermore, in step S1, for example, the tap generation section 122 also generate a class tap from the synthesized speech of the subject subframe, and the I code of the subframe, which will be described later, and supplies the class tap to the classification section 123.

Then, the process proceeds to step S2, where the classification section 123 performs classification on the basis of the class tap supplied from the tap generation section 122, and supplies the resulting class code to the coefficient memory 124, and then the process proceeds to step S3.

In step S3, the coefficient memory 124 reads a tap coefficient from the address corresponding to the class code supplied from the classification section 123, and supplies the tap coefficient to the prediction section 125.

Then, the process proceeds to step S4, where the prediction section 125 obtains the tap coefficient output from the coefficient memory 124, and performs the sum-of-products computation shown in equation (6) by using the tap coefficient and the prediction tap from the tap generation section 121, so that (the prediction value of) the high-quality sound data of the subject subframe is obtained.

The processes of steps S1 to S4 are performed by using each of the sample values of the synthesized speech data of the subject subframe in sequence as subject data. That is, since the synthesized speech data of the subframe is composed of 40 samples, as described above, the processes of steps S1 to S4 are performed for each of the synthesized speech data for the 40 samples.

The high-quality sound obtained in the above-described manner is supplied from the prediction section 125 via the D/A conversion section 30 to a speaker 31, whereby high-quality sound is output from the speaker 31.

After the process of step S4, the process proceeds to step S5, where it is determined whether or not there are any more subframes to be processed as subject subframes. When it is determined that there is a subframe to be processed as subject subframe, the process returns to step S1, where a subframe to be used as the next subject subframe is newly used as a subject subframe, and hereafter, the same processes are repeated. When it is determined in step S5 that there is no subframe to be processed as a subject subframe, the processing is terminated.

Figure 7:
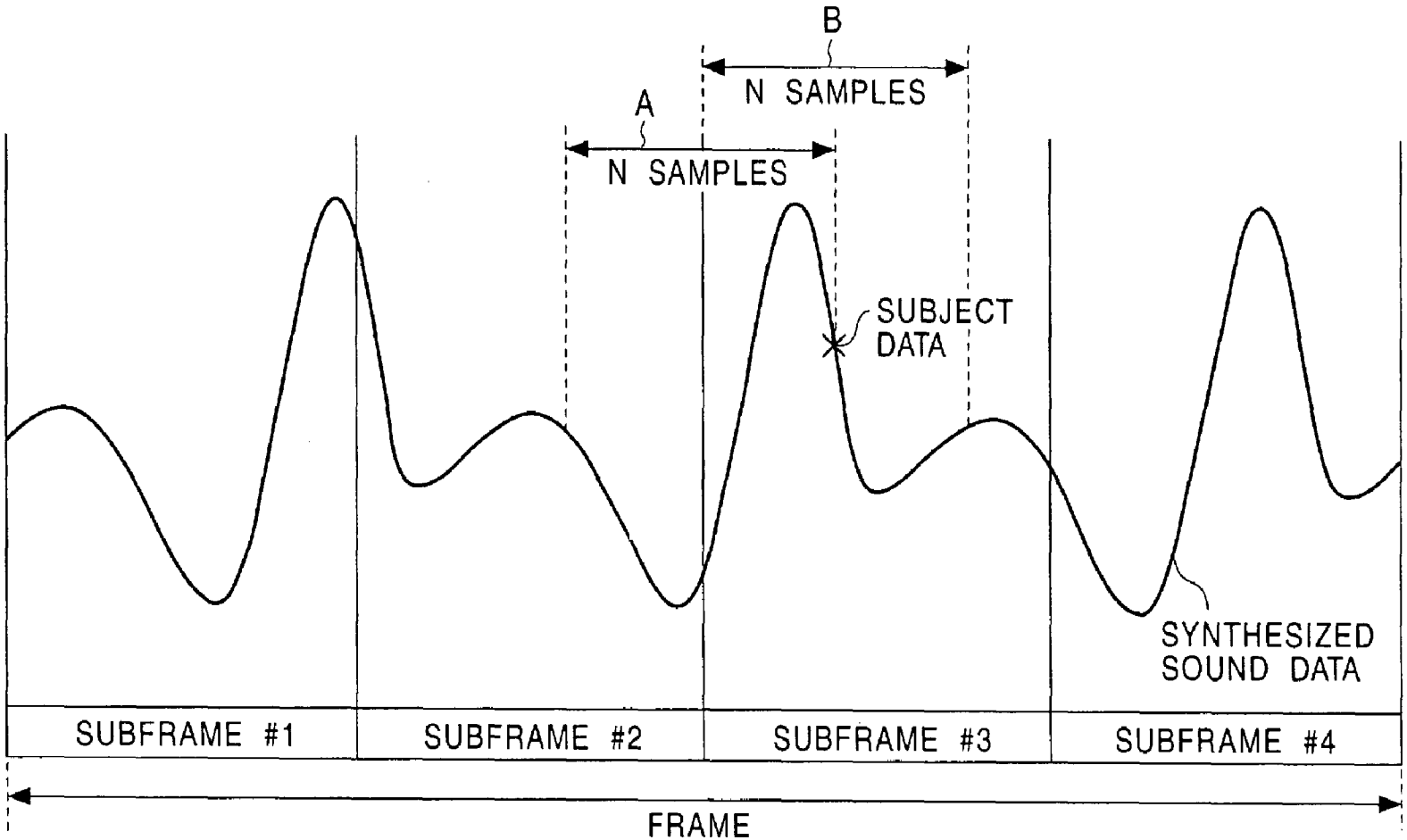
FIG. 7 illustrates a method of generating a prediction tap and a class tap.

Next, referring to FIG. 7, a description is given of a method of generating a prediction tap in the tap generation section 121 of FIG. 5.

For example, as shown in FIG. 7, the tap generation section 121 assumes each synthesized speech data (the synthesized speech data output from the speech synthesis filter 29) of the subframe to be subject data, and extracts, as a prediction tap, the synthesized speech data of past N samples (the synthesized speech data in the range shown in A in FIG. 7) from the subject data and the past and future synthesized speech data of a total of N samples (the synthesized speech data in the range shown in B in FIG. 7) with the subject data being the center.

Furthermore, the tap generation section 121 also extracts, for example, as a prediction tap, the subframe (subframe #3 in the embodiment of FIG. 7) at which the subject data is positioned, that is, the I code located in the subject subframe.

Therefore, in this case, the prediction tap is formed of the synthesized speech data of N samples containing the subject data, and the I code of the subject subframe.

Also, in the tap generation section 122, for example, in the same manner as in the case of tap generation section 121, a class tap formed of synthesized speech data and the I code is extracted.

However, the structure pattern of the prediction tap and the class tap are not limited to the above-described patterns. That is, as the prediction tap and the class tap, in addition to extracting, from the subject data, the synthesized speech data of all the N samples such as that described above, it is possible to extract synthesized speech data every other sample.

Furthermore, although in the above-described case, the class tap and the prediction tap are formed in the same ways, the class tap and the prediction tap can be formed in different ways.

The prediction tap and the class tap can be formed only from synthesized speech data. However, in the manner described above, also, by forming the prediction tap and the class tap by using the I code as information related to the synthesized speech data in addition to the synthesized speech data, it becomes possible to decode higher-quality sound.

However, in the manner of the above-described case, when only the I code located in the subframe where the subject data is positioned (subject subframe) is contained in the prediction tap and the class tap, a balance, so to speak, between the synthesized speech data which forms the prediction tap and the class tap, and the I code is not achieved. For this reason, there is a risk that the sound-quality improvement effect by the class classification and adaptation process cannot be obtained sufficiently.

More specifically, for example, in FIG. 7, when the synthesized speech data of past N samples from the subject data (the synthesized speech data in the range shown in A in FIG. 7) is to be contained in the prediction tap, the synthesized speech data which is used as the prediction tap contains not only the synthesized speech data of the subject subframe, but also the synthesized speech data of the subframe immediately before. Therefore, in this case, if the I code located in the subject subframe is to be contained in the prediction tap, unless the I code located in the subframe immediately before is contained in the prediction tap, there is a risk in that the relationship between the synthesized speech data which forms the prediction tap, and the I code does not become a balanced one.

Therefore, the subframe of the I code from which the prediction tap and the class tap are formed can be made variable according to the position of the subject data in the subject subframe.

More specifically, for example, in a case where the synthesized speech data contained in the prediction tap which is formed from the subject data extends up to the subframe adjacent immediately before or after the subject subframe (hereinafter referred to as an "adjacent subframe") or in a case where the synthesized speech data extends up to a position near the adjacent subframe, it is possible to form the prediction tap so as to contain not only the I code of the subject subframe, but also the I code of the adjacent subframe. The class tap can also be formed in the same manner.

In this manner, by forming the prediction tap and the class tap so that the balance between the synthesized speech data and the I code, which form the prediction tap and the class tap, is achieved, it becomes possible to obtain a sufficient sound-quality improvement effect due to a classification and adaptation process.

Figure 8:
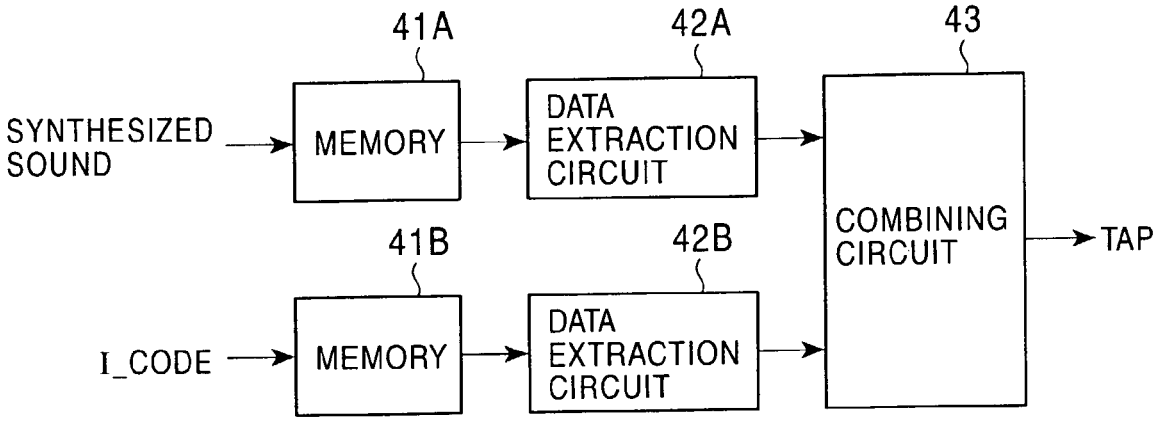
FIG. 8 is a block diagram showing an example of the configuration of tap generation sections 121 and 122.

FIG. 8 shows an example of the configuration of the tap generation section 121 for forming the prediction tap so as to be able to achieve a balance between the synthesized speech data and the I code, which form the prediction tap, by making the subframe of the I code which forms the prediction tap variable according to the position of the subject data in the subject subframe in the above-described manner. The tap generation section 122 for forming a class tap can also be formed similarly to that of FIG. 8.

The synthesized speech data output from the speech synthesis filter 29 of FIG. 5 is supplied to a memory 41A, and the memory 41A temporarily stores the synthesized speech data supplied thereto. The memory 41A has at least a storage capacity capable of storing the synthesized speech data of N samples which form one prediction tap. Furthermore, the memory 41A stores the latest sample of the synthesized speech data supplied thereto in sequence in such a manner as to overwrite on the oldest stored value.

Then, a data extraction circuit 42A extracts, from the subject data, the synthesized speech data which forms the prediction tap by reading it from the memory 41A, and outputs the synthesized speech data to a combining circuit 43.

More specifically, when, for example, the latest synthesized speech data stored in the memory 41A is assumed to be subject data, the data extraction circuit 42A extracts the synthesized speech data of past N samples from the latest synthesized speech data by reading it from the memory 41A, and outputs the data to the combining circuit 43.

As shown in B in FIG. 7, when past and future synthesized speech data of N samples with the subject data as the center are to be used as prediction taps, the synthesized speech data in the past by N/2 (decimal places are, for example, raised to the next whole number) samples from the latest synthesized speech data within the synthesized speech data stored in the memory 41A may be assumed to be subject data, and past and future synthesized speech data of a total of N samples with the subject data being the center may be read from the memory 41A.

Meanwhile, the I codes in subframe units, output from the channel decoder 21 of FIG. 5, are supplied to a memory 41B, and the memory 41B temporarily stores the I code supplied thereto. The memory 41B has at least a storage capacity capable of storing I codes for an amount capable of forming one prediction tap. Furthermore, similarly to the memory 41A, the memory 41B stores the latest I code supplied thereto in such a manner as to overwrite on the oldest stored value.

Then, a data extraction circuit 42B extracts only the I code of the subject subframe, or the I code of the subject subframe and the I code of the subframe adjacent to the subject subframe (adjacent subframe) by reading them from the memory 41B according to the position of the synthesized speech data which is assumed to be subject data by the data extraction circuit 42A in the subject subframe, and outputs them to the combining circuit 43.

The combining circuit 43 combines (merges) the synthesized speech data from the data extraction circuit 42A and the I code from the data extraction circuit 42B into one set of data, and outputs it as the prediction tap.

In the tap generation section 121, when the prediction tap is to be generated in the above-described manner, the synthesized speech data which forms the prediction tap is fixed at N samples. However, for the I code, there is a case in which it is only the I code of the subject subframe, and there is a case in which it is the I code of the subject subframe and the I code of the subframe adjacent to the subject subframe (adjacent subframe). Therefore, the number of the I codes varies. This applies the same to the class tap generated in the tap generation section 122.

For the prediction tap, even if the number of data (number of taps) which forms it varies, no problem is posed because the same number of the tap coefficients as the number of prediction taps need only be learnt in the learning apparatus of FIG. 13 (to be described later) and the tap coefficients need only be stored in the coefficient memory 124.

On the other hand, for the class tap, if the number of taps which form the class tap varies, the number of all the classes obtained by the class tap varies, presenting the risk that the processing becomes complex. Therefore, it is preferable that classification in which, even if the number of taps of the class tap varies, the number of classes obtained by the class tap does not vary be performed.

As a method of performing classification in which, even if the number of taps of the class tap varies, the number of classes obtained by the class tap does not vary, there is a method in which, for example, the position of the subject data in the subject subframe is taken into consideration.

More specifically, in this embodiment, the number of taps of the class tap increases or decreases according to the position of the subject data in the subject subframe. For example, it is assumed that there are cases in which the number of taps of the class tap is S and L which is greater than S (>S), and when the number of taps is S, a class of n bits is obtained, and when the number of taps is L, a class code of n+m bits is obtained.

In this case, as the class code, n+m+1 bits are used, and, for example, 1 bit, such as the highest-order bit, within the n+m+1 bits is set to, for example, "0" and "1" depending on the case in which the number of class taps is S and L. As a result, even if the number of taps is either S or L, classification in which the total number of classes is $2^{n+m+1}$ becomes possible.

More specifically, when the number of class taps is L, classification in which a class code of n+m bits is obtained may be performed, and n+m+1 bits such that "1" as the highest-order bit indicating that the number of taps is L is added to the class code of the n+m bits may be assumed to be the final class code.

Furthermore, when the number of taps of the class tap is S, classification in which a class code of n bits is obtained may be performed, "0" of m bits as the high-order bits may be added to the class code of the n bits so as to be formed as n+m bits, and n+m+1 bits such that "0", as the highest-order bit, indicating that the number of class taps is S is added to the n+m bits may be assumed to be the final class code.

In the above-described manner, even if the number of taps of the class tap is either S or L, classification in which the total number of classes is $2^{n+m+1}$ becomes possible. When the number of taps is S, the bits from the second bit counting from the highest-order bit up to the (m+1)-th bit always become "0".

Therefore, as described above, when classification in which a class code of n+m+1 bits is output is performed, (a class code indicating) a class which is not used occurs, that is, a useless class, so to speak, occurs.

Therefore, in order that occurrence of such a useless class be prevented to make the total number of classes fixed, classification can be performed by providing a weight to the data which forms the class tap.

Figure 9A:
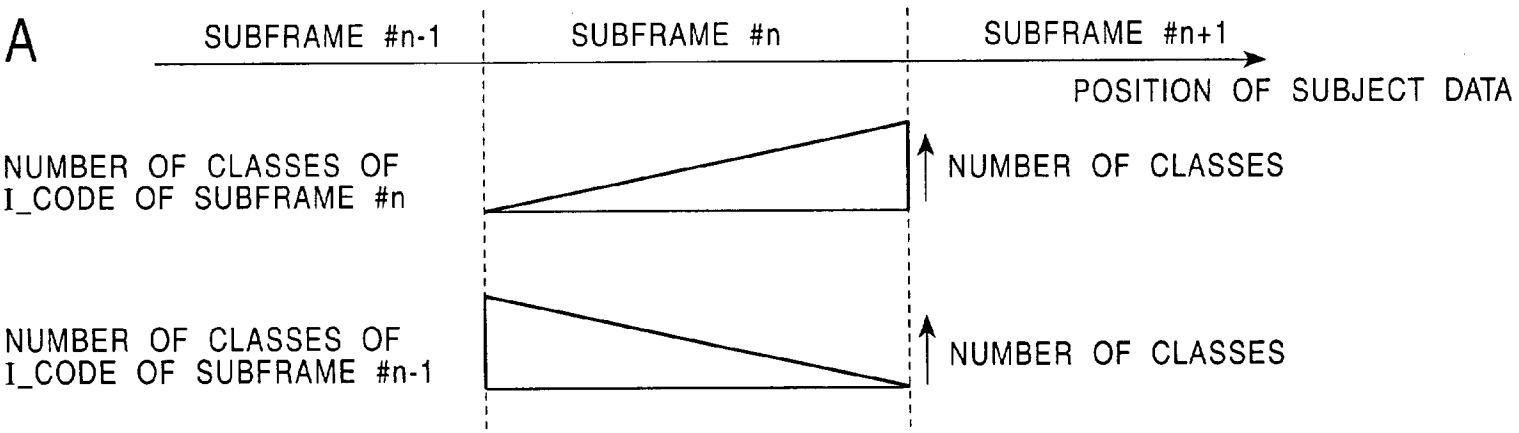
FIGS. 9A and 9B illustrate a method of weighting with respect to a class by an I code.

More specifically, for example, in a case where the synthesized speech data of N samples which is past from the subject data, shown in A in FIG. 7, is to be contained in a class tap, and one or both of the I code of the subject subframe (hereinafter referred to as a "subject subframe #n" where appropriate) and the I code of subframe #n−1 immediately before are to be contained in the class tap according to the position of the subject data in the subject subframe, for example, weighting such as that shown in FIG. 9A is performed to the number of classes corresponding to the I code of the subject subframe #n which forms the class tap and the number of classes corresponding to the I code of the subframe #n−1 immediately before, allowing the number of classes to be fixed.

That is, FIG. 9A shows that classification is performed in which the more to the right (future) of the subject subframe #n the subject data is positioned, the more the number of classes corresponding to the I code of subject subframe #n is increased. Furthermore, FIG. 9A shows that classification is performed in which the more to the right of the subject subframe #n the subject data is positioned, the more the number of classes corresponding to the I code of subframe #n−1 immediately before is decreased. As a result of weighting such as that shown in FIG. 9A being performed, classification in which the overall number of classes becomes fixed is performed.

Figure 9B:
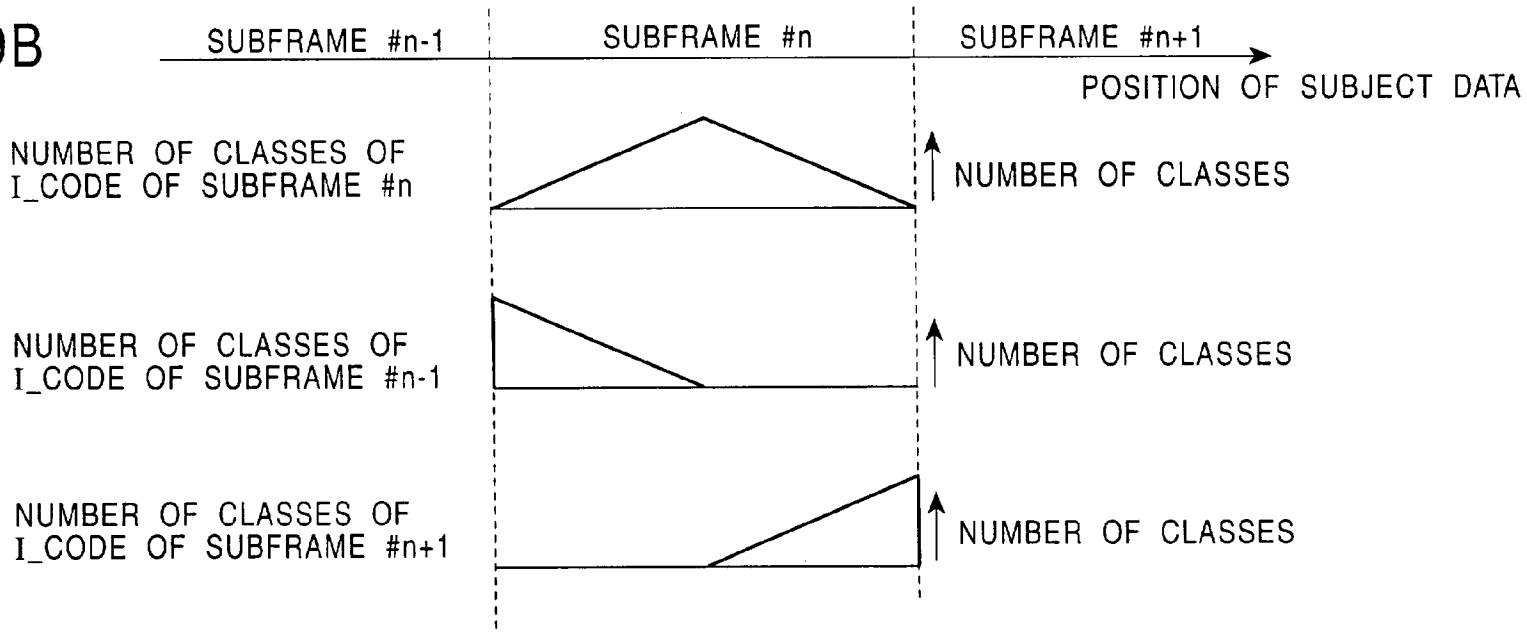

Furthermore, for example, in a case where the past and future synthesized speech data of a total of N samples, shown in B in FIG. 7, with the subject data being the center is to be contained in the class tap, and the I code of subject subframe #n and one or both of the I codes of subframe #n-1 immediately before and subframe #n+1 immediately after are to be contained in the class tap, for example, weighting such as that shown in FIG. 9B is performed to the number of classes corresponding to the I code of the subject subframe #n which forms the class tap, the number of classes corresponding to the I code of subframe #n−1 immediately before, and the I code of the number of classes corresponding to the I code of subframe #n+1 immediately after, allowing the number of classes to be fixed.

That is, FIG. 9B shows that classification in which the more close to the center position of the subject subframe #n the subject data is, the more the number of classes corresponding to the I code of subject subframe #n is increased. Furthermore, FIG. 9B shows that classification in which the more to the left (in the past) of subject subframe #n the subject data is positioned, the more the number of classes corresponding to the I code of subframe #n−1 immediately before the subject subframe #n is increased, and the more to the right (in the future) of the subject subframe #n the subject data is positioned, the more the number of classes corresponding to the I code of subject subframe #n+1 immediately after subject subframe #n is increased. As a result of weighting such as that shown in FIG. 9B being performed, classification in which the overall number of classes becomes fixed is performed.

Next, FIG. 10 shows an example of weighting in a case where classification in which the number of classes corresponding to the I code becomes fixed at 512.

More specifically, FIG. 10A shows a specific example of weighting shown in FIG. 9A in a case where one or both of the I code of subject subframe #n and the I code of subframe #n−1 immediately before are contained in the class tap according to the position of the subject data in the subject subframe.

FIG. 10B shows a specific example of weighting shown in FIG. 9B in a case where the I code of subject subframe #n, and one or both of the I code of subject subframe #n−1 immediately before and the I code of subframe #n+1 immediately after are contained in the class tap according to the position the subject data in the subject subframe.

In FIG. 10A, the leftmost column shows the position of the subject data in the subject subframe from the left end. The second column from the left shows the number of classes by the I code of the subframe immediately before the subject subframe. The third column from the left shows the number of classes by the I code of the subject subframe. The rightmost column shows the number of classes by the I code which forms the class tap (the number of classes by the I code of the subject subframe and the I code of the subframe immediately before).

Here, for example, as described above, since the subframe is composed of 40 samples, the position of the subject data in the subject subframe from the left end (the leftmost column) takes a value in the range of 1 to 40. Furthermore, for example, as described above, since the I code is 9 bits long, there is a case in which the number of classes becomes a maximum when the 9 bits are directly assumed to be a class code. Therefore, the number of classes by the I code (the second and third columns from the left) takes a value of $2^9$ (=512) or lower.

Furthermore, as described above, when one I code is directly used as a class code, the number of classes becomes 512 ($2^9$). Therefore, in FIG. 10A (the same applies in FIG. 10B, which will be described later), weighting is performed to the number of classes by the I code of the subject subframe and the number of classes by the I code of the subframe immediately before so that the number of classes by all the I codes which form the class tap (the number of classes by the I code of the subject subframe and by the I code of the subframe immediately before) becomes 512, that is, the product of the number of classes by the I code of the subject subframe and the number of classes by the I code of the subframe immediately before becomes 512.

In FIG. 10A, as described in FIG. 9A, the more to the right of subject subframe #n the subject data is positioned (the more the value indicating the position of the subject data is increased), the more the number of classes corresponding to the I code of subject subframe #n is increased and the number of classes corresponding to the I code of subframe #n−1 immediately before subject subframe #n is decreased.

In FIG. 10B, the leftmost column, the second column from the left, the third column from the left, and the rightmost column show the same contents as in the case of FIG. 10A. The fourth column from the left shows the number of classes by the I code of the subframe immediately after the subject subframe.

In FIG. 10B, as described in. FIG. 9B, the more away from the center position of subject subframe #n the subject data is (the more the value indicating the position of the subject data is increased or decreased), the number of classes corresponding to the I code of subject subframe #n is decreased. Furthermore, the more to the left of subject subframe #n the subject data is positioned, the more the number of classes corresponding to the I code of subframe #n−1 immediately before subject subframe #n is increased. In addition, the more to the right of subject subframe #n the subject data is positioned, the more the number of classes corresponding to the I code of subframe #n+1 immediately after subject subframe #n is increased.

Figure 11:
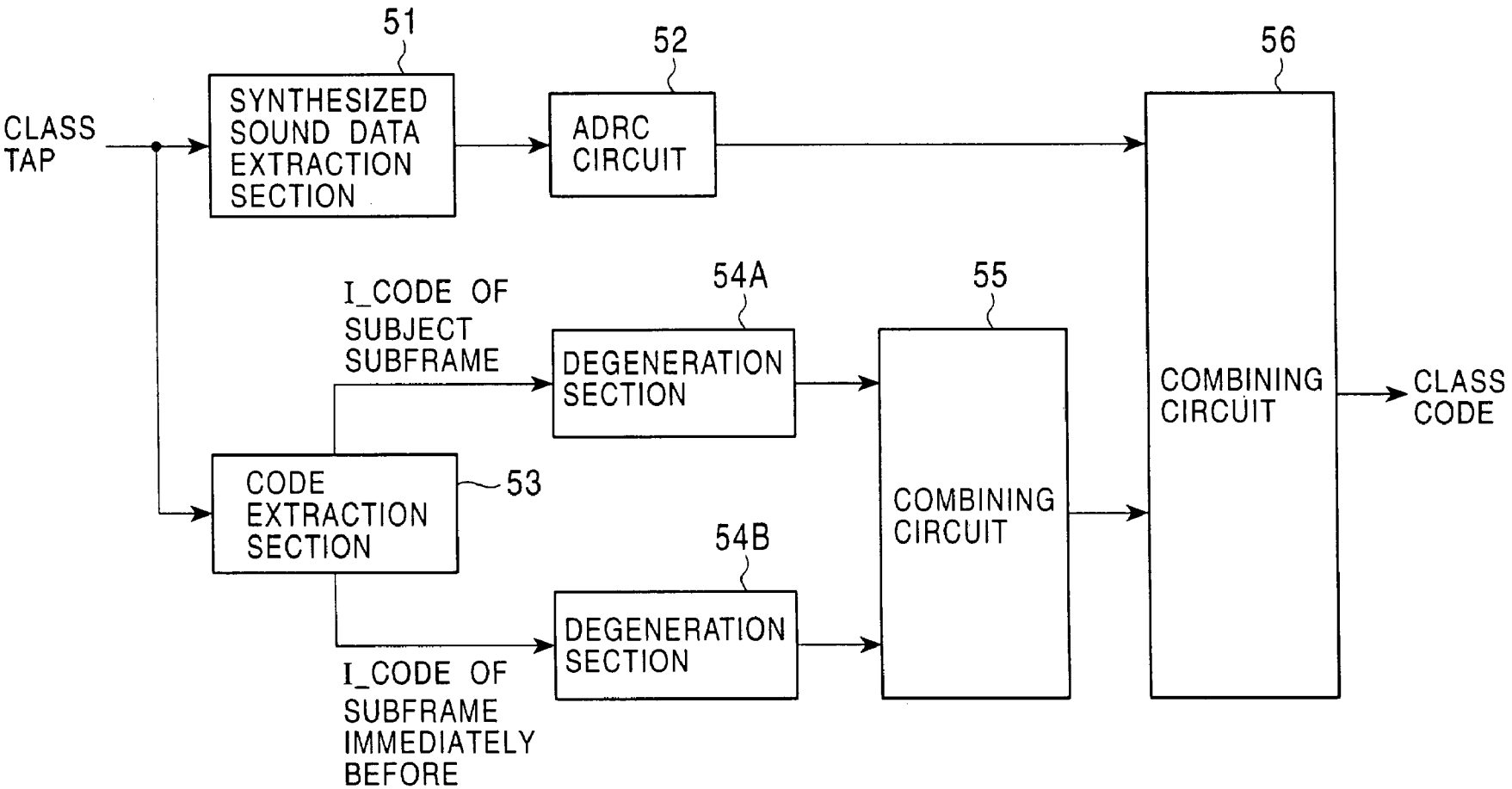
FIG. 11 is a block diagram showing an example of the configuration of a classification section 123.

FIG. 11 shows an example of the configuration of the classification section 123 of FIG. 5 for performing classification involving weighting such as that described above.

Here, it is assumed that the class tap is composed of, for example, the synthesized speech data of N samples in the past from the subject data, and the I codes of the subject data and the subframe immediately before, shown in A in FIG. 7.

The class tap output from the tap generation section 122 (FIG. 5) is supplied to a synthesized speech-data extraction section 51 and a code extraction section 53.

The synthesized speech-data extraction section 51 cuts out (extracts), from a class tap supplied thereto, synthesized speech data of a plurality of samples forming the class tap, and supplies the synthesized speech data to an ADRC circuit 52. The ADRC circuit 52 performs, for example, a one-bit ADRC process on a plurality of items of synthesized speech data (here, the synthesized speech data of N samples) supplied from the synthesized speech-data extraction section 51, and supplies a bit sequence, in which one bit for a plurality of items of resulting synthesized speech data is arranged in a predetermined order, to a combining circuit 56.

Meanwhile, the code extraction section 53 cuts out (extracts) the I code which forms the class tap from the class tap supplied thereto. Furthermore, the code extraction section 53 supplies the I code of the subject subframe and the I code of the subframe immediately before among the cutout I codes to degeneration section 54A and 54B, respectively.

The degeneration section 54A stores a degeneration table created by a table creation process (to be described later). In the manner described in FIGS. 9 and 10, by using the degeneration table, the degeneration section 54A degenerates (decreases) the number of classes represented by the I code of the subject subframe according to the position of the subject data in the subject subframe, and supplies the number of classes to a synthesis circuit 55.

That is, when the position of the subject data in the subject subframe is one of the first to the fourth from the left, the degeneration section 54A performs a degeneration process so that, for example, as shown in FIG. 10A, the number of classes of 512 represented by the I code of the subject subframe is made to be 512, that is, an I code of 9 bits of the subject subframe is not particularly processed and is directly output.

Furthermore, when the position of the subject data in the subject subframe is one of the fifth to the eighth from the left, for example, as shown in FIG. 10A, the degeneration section 54A performs a degeneration process so that the number of classes of 512 indicated by the I code of the subject subframe becomes 256, that is, the I code of 9 bits of the subject subframe is converted into a code indicated by 8 bits by using a degeneration table, and this code is output.

Furthermore, when the position of the subject data in the subject subframe is one of the ninth to the twelfth from the left, for example, as shown in FIG. 10A, a degeneration section 54A performs a degeneration process so that the number of classes of 512 indicated by the I code of the subject subframe becomes 128, that is, the I code of 9 bits of the subject subframe is converted into a code indicated by 7 bits by using the degeneration table, and code this is output.

Hereafter, in a similar manner, the degeneration section 54A degenerates the number of classes indicated by the I code of the subject subframe as shown in the second column from the left of FIG. 10A according to the position of the subject data in the subject subframe, and outputs the number of classes to a combining circuit 55.

The degeneration section 54B also stores a degeneration table similarly to the degeneration section 54A. By using the degeneration table, the degeneration section 54B degenerates the number of classes indicated by the I code of the subframe as shown in the third column from the left of FIG. 10A according to the position of the subject data in the subject subframe, and outputs the number of classes to the combining circuit 55.

The combining circuit 55 combines the I code of the subject subframe in which the number of classes is degenerated as appropriate, from the degeneration section 54A, and the I code of the subframe immediately before the subject subframe, in which the number of classes is degenerated as appropriate, from the degeneration circuit 54B, into one bit sequence, and supplies the bit sequence to a combining circuit 56.

The combining circuit 56 combines the bit sequence output from the ADRC circuit 52 and the bit sequence output from the combining circuit 55 into one bit sequence, and supplies the bit sequence as a class code.

Figure 12:
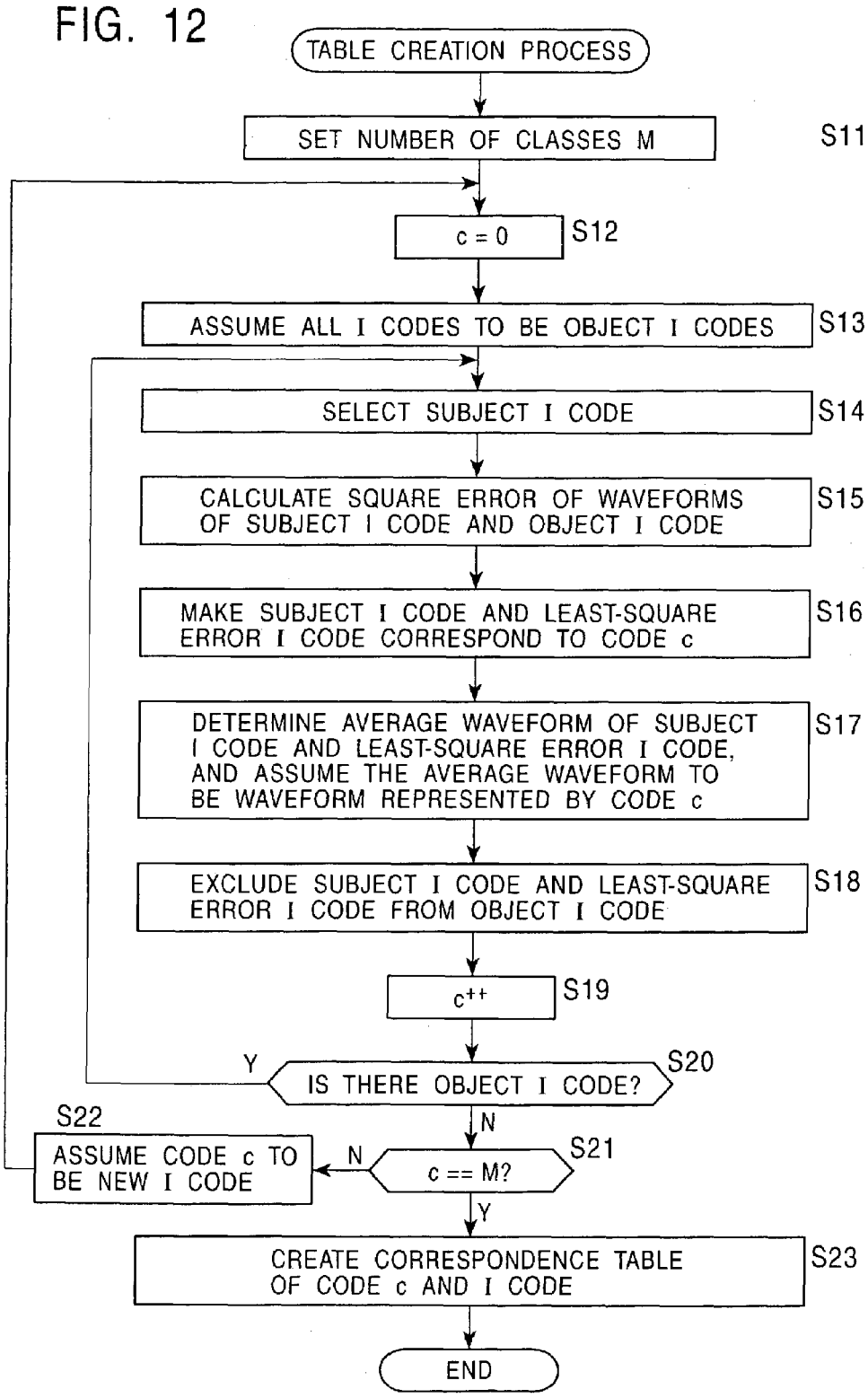
FIG. 12 is a flowchart illustrating a table creation process.

Next, referring to the flowchart in FIG. 12, a description is given of a table creation process of creating a degeneration table used in the degeneration sections 54A and 54B of FIG. 11.

In the degeneration table creation process, initially, in step S11, a number of classes M after degeneration is set. Here, for simplicity of description, for example, M is set as a value which is raised to a power of 2. Furthermore, here, since a degeneration table for degenerating the number of classes represented by the I code of 9 bits is created, M is set to a value of 512 which is the maximum number of classes indicated by an I code of 9 bits or lower.

Thereafter, the process proceeds to step S12, where a variable c indicating the class code after degeneration is set to "0", and the process proceeds to step S13. In step S13, all the I codes (first, all the numbers indicated by the I code of 9 bits) are set as object I codes for the object of processing, and the process proceeds to step S14. In step S14, one of the object I codes is selected as a subject I code, and the process proceeds to step S15.

In step S15, the square error of a waveform represented by the I code (waveform of an excitation signal) and each of waveforms represented by all the object codes is calculated.

More specifically, as described above, the I code corresponds to a predetermined excitation signal. In step S15, the sum of the square errors of each sample value of the waveform of the excitation signal represented by the subject I code and the corresponding sample value of the waveform of the excitation signal represented by the object I codes is determined. In step S15, such a sum of square error for the subject I codes is determined by using all the object I codes as objects.

Thereafter, the process proceeds to step S16, where the object I code at which the sum of the square errors for the subject I code is minimized (hereinafter referred to as a "least-square error I code" where appropriate) is detected, and the subject I code and the least-square error I code are made to correspond to the code represented by the variable c. That is, as a result, the subject I code, and the object I code representing the waveform which most resembles the waveform represented by the subject I code (the least-square error I code) among the object I codes are degenerated into the same class c.

After the process of step S16, the process proceeds to step S17, where, for example, an average value of each sample value of the waveform represented by the subject I code and the corresponding sample value of the waveform represented by the least-square error I code is determined, and the waveform by the average value is, as the waveform of the excitation signal represented by the variable c, made to correspond to the variable c.

Then, the process proceeds to step S18, where the subject I code and the least-square error I code are excluded from the object I codes. Then, the process proceeds to step S19, where the variable c is incremented by 1, and the process proceeds to step S20.

In step S20, it is determined whether or not there is an I code for an object I code. When it is determined that there is an I code for an object I code, the process returns to step S14, where a new subject I code is selected from the I code for an object I code, and hereafter, the same processes are repeated.

When it is determined in step S20 that there is no I code for an object I code, that is, when the I code which is made to be an object I code in the previous step S13 is made to correspond to variables c in a number of ½ of the total number of the I codes, the process proceeds to step S21, where it is determined whether or not the variable c is equal to the number of classes M after degeneration.

When it is determined in step S21 that the variable c is not equal to the number of classes M after degeneration, that is, when the number of classes represented by the I code of 9 bits is not yet degenerated into the M classes, the process proceeds to step S22, where each value represented by the variable c is newly assumed to be an I code. Then, the process returns to step S12, and hereafter, by using the new I code as an object, the same processes are repeated.

Regarding the new I code, by using the waveform determined in step S17 as a waveform of the excitation signal indicated by the new I code, the square error in step S15 is calculated.

On the other hand, when it is determined in step S21 that the variable c is equal to the number of classes M after degeneration, that is, when the number of classes represented by the I code of 9 bits is degenerated into the M classes, the process proceeds to step S23, where a correspondence table between each value of the variables c and the I code of 9 bits corresponding to the value is created, the correspondence table is output as a degeneration table, and the processing is then terminated.

In the degeneration sections 54A and 54B of FIG. 11, the I code of the 9 bits supplied thereto is degenerated as a result of being converted into a variable c which is made to correspond to the I code of the 9 bits in the degeneration table created in the above-described manner.

In addition, for example; the degeneration of the number of classes by the I code of the 9 bits can also be performed by simply deleting the low-order bits of the I code. However, it is preferable that the degeneration of the number of classes be performed in such a manner that the resembling classes are collected. Therefore, instead of simply deleting the low-order bits of the I code, as described in FIG. 12, the I codes indicating the excitation signal having resembling waveforms are preferably assigned to the same class.

Figure 13:
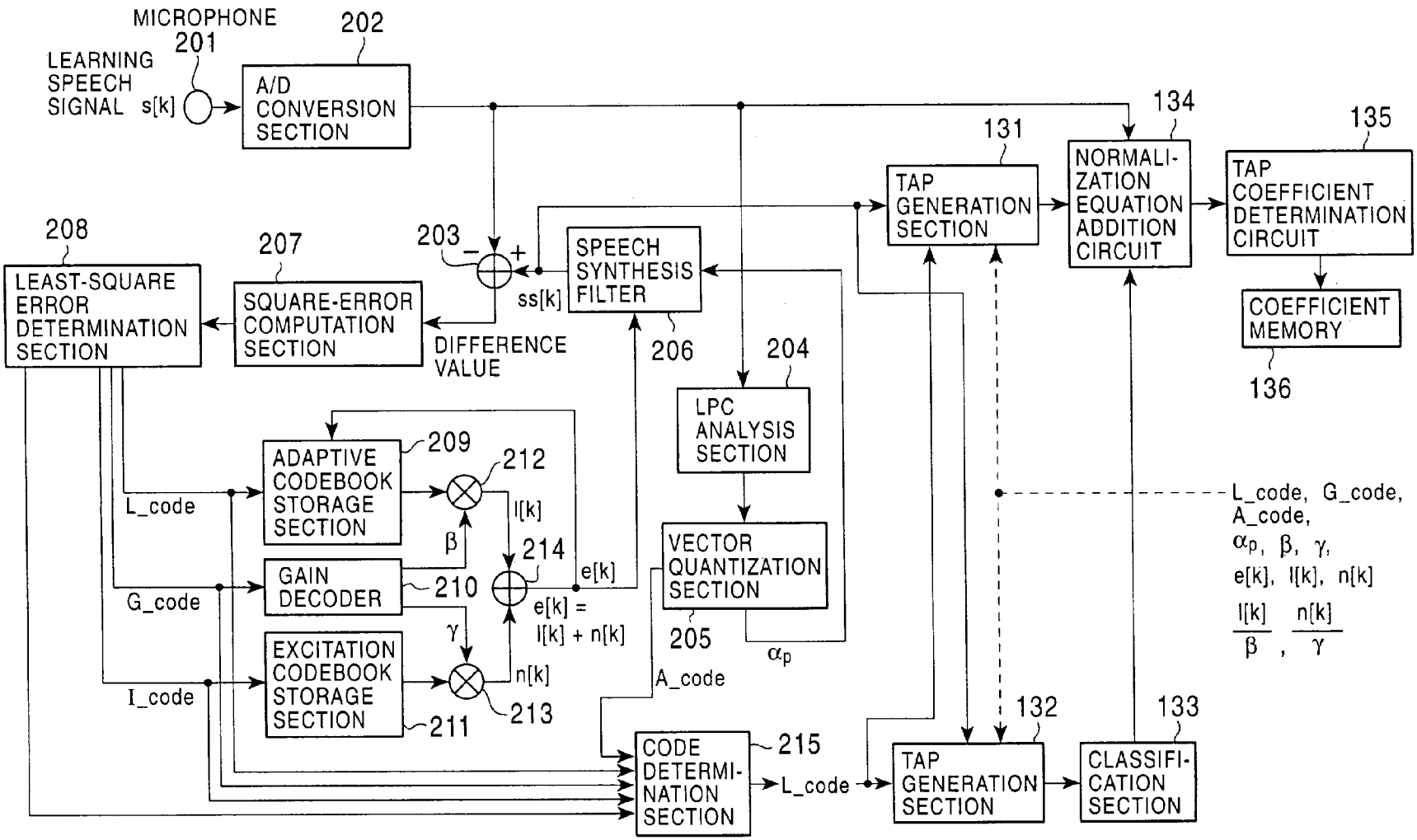
FIG. 13 is a block diagram showing an example of the configuration of an embodiment of a learning apparatus according to the present invention.

Next, FIG. 13 shows an example of the configuration of an embodiment of a learning apparatus for performing a process of learning tap coefficients stored in the coefficient memory 124 of FIG. 5.

Figure 1:
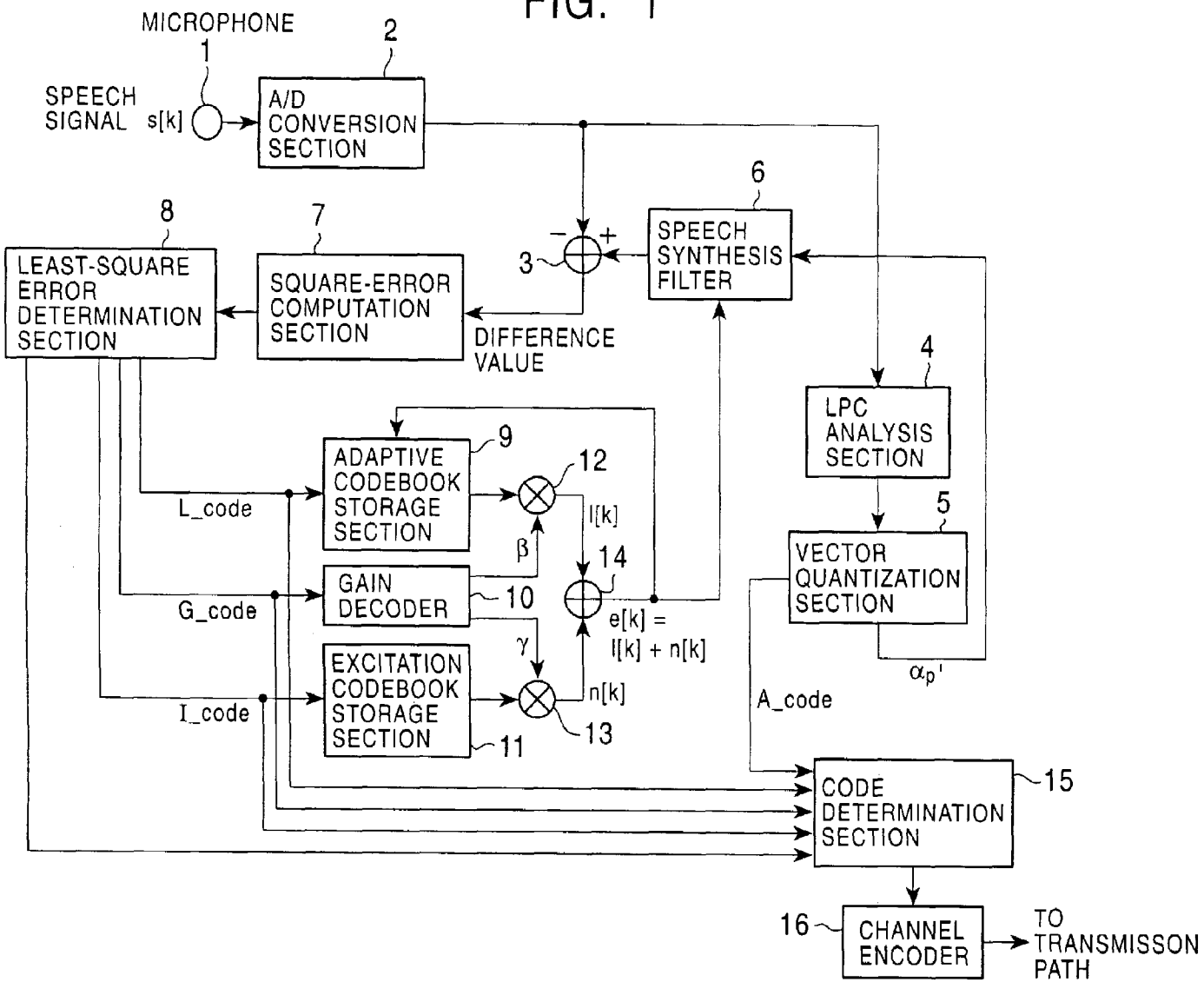
FIG. 1 is a block diagram showing the configuration of an example of a transmission section of a conventional mobile phone.

A series of components from a microphone 201 to a code determination section 215 are formed similarly to the series of components from the microphone 1 to the code determination section 15 of FIG. 1, respectively. A learning speech signal of high quality is input to the microphone 1, and therefore, in the microphone 201 to the code determination section 215, the same processes as in the case of FIG. 1 are performed on the learning speech signal.

However, the code determination section 215 outputs only the L codes which form the prediction tap and the class tap in this embodiment among the L code, the G code, the I code, and the A code.

Then, the synthesized speech output by the speech synthesis filter 206 when it is determined in the least-square error determination section 208 that the square error reaches a minimum is supplied to tap generation sections 131 and 132. Furthermore, an I code which is output by the code determination section 215 when the code determination section 215 receives a determination signal from the least-square error determination section 208 is also supplied to the tap generation sections 131 and 132. Furthermore, speech output by an A/D conversion section 202 is supplied as teacher data to a normalization equation addition circuit 134.

The generation section 131 generates the same prediction tap as in the case of the tap generation section 121 of FIG. 5 from the synthesized speech data output from the speech synthesis filter 206 and the I code output from the code determination section 215, and supplies the prediction tap as student data to the normalization equation addition circuit 134.

The tap generation section 132 also generates the same class tap as in the case of the tap generation section 122 of FIG. 5 from the synthesized speech data output from the speech synthesis filter 206 and the I code output from the code determination section 215, and supplies the class tap to a classification section 133.

The classification section 133 performs the same classification as in the case of the classification section 123 of FIG. 5 on the basis of the class tap from the tap generation section 132, and supplies the resulting class code to the normalization equation addition circuit 134.

The normalization equation addition circuit 134 receives speech from the A/D conversion section 202 as teacher data, and receives the prediction tap from the generation section 131 as student data, and performs addition for each class code from the classification section 133 by using the teacher data and the student data as objects.

More specifically, the normalization equation addition circuit 134 performs, for each class corresponding to the class code supplied from the classification section 133, multiplication of the student data ($x_{in}x_{im}$) which is each component in the matrix A of equation (13), and a computation equivalent to summation (Σ), by using the prediction tap (student data).

Furthermore, the normalization equation addition circuit 134 also performs, for each class corresponding to the class code supplied from the classification section 133, multiplication of the student data and the teacher data ($x_{in}y_i$) which is each component in the vector v of equation (13), and a computation equivalent to summation (Σ), by using the student data and the teacher data.

The normalization equation addition circuit 134 performs the above-described addition by using all the subframes of the speech for learning supplied thereto as the subject subframes. As a result, a normalization equation shown in equation (13) is formulated for each class.

A tap coefficient determination circuit 135 determines the tap coefficient for each class by solving the normalization equation generated for each class in the normalization equation addition circuit 134, and supplies the tap coefficient to the address, corresponding to each class, of the coefficient memory 136.

Depending on the speech signal prepared as a learning speech signal, in the normalization equation addition circuit 134, a class may occur at which normalization equations of a number required to determine the tap coefficient are not obtained. For such a class, the tap coefficient determination circuit 135 outputs, for example, a default tap coefficient.

The coefficient memory 136 stores the tap coefficient for each class supplied from the tap coefficient determination circuit 135 at an address corresponding to that class.

Figure 14:
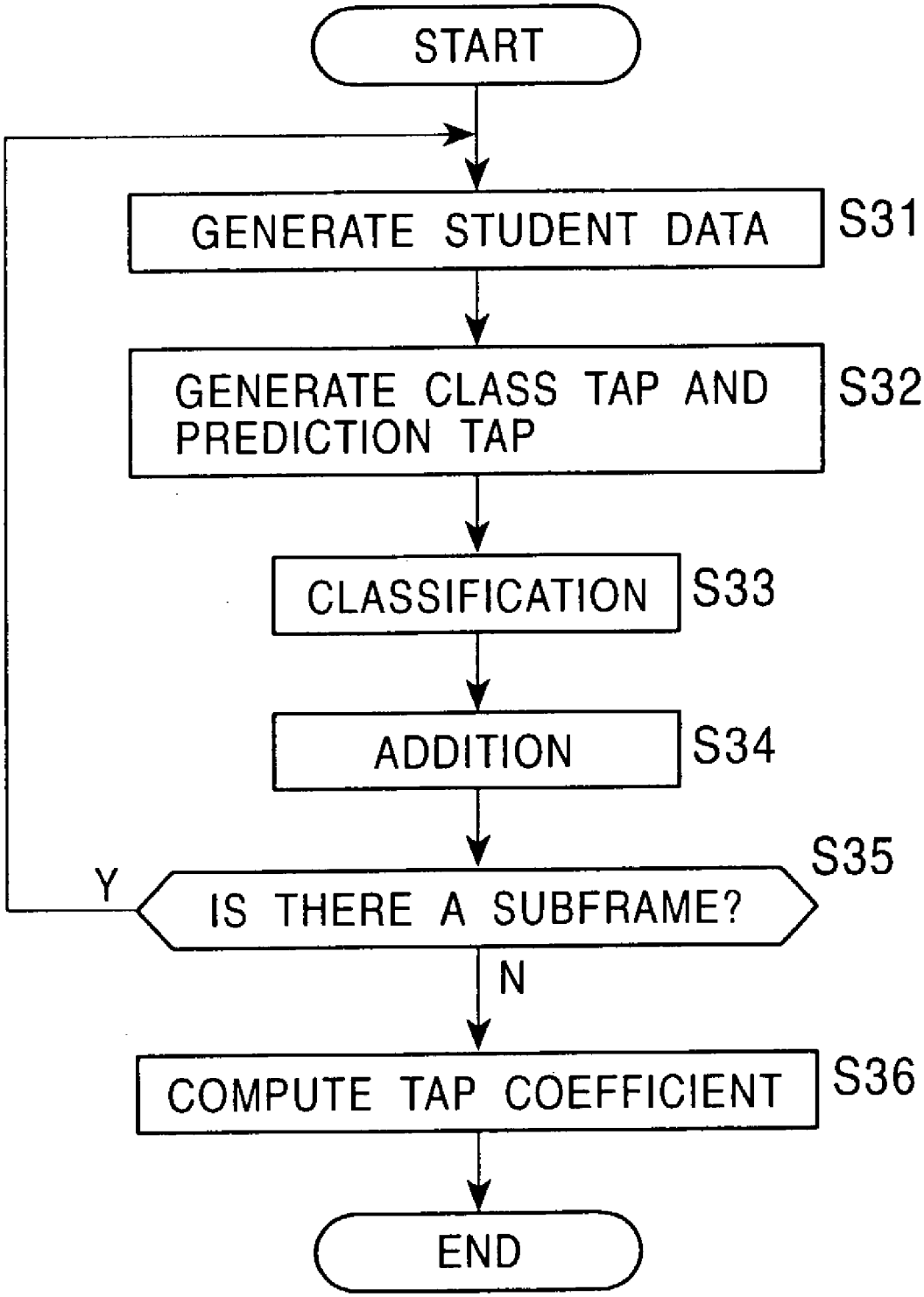
FIG. 14 is a flowchart illustrating a learning process.

Next, referring to the flowchart in FIG. 14, a description is given of a learning process of determining a tap coefficient for decoding high-quality sound, performed in the learning apparatus of FIG. 13.

More specifically, a learning speech signal is supplied to the learning apparatus. In step S31, teacher data and student data are generated from the learning speech signal.

More specifically, the learning speech signal is input to the microphone 201, and the microphone 201 to the code determination section 215 perform the same processes as in the case of the microphone 1 to the code determination section 15 in FIG. 1, respectively.

As a result, the speech of the digital signal obtained by the A/D conversion section 202 is supplied as teacher data to the normalization equation addition circuit 134. Furthermore, when it is determined in the least-square error determination section 208 that the square error reaches a minimum, the synthesized speech data output from the speech synthesis filter 206 is supplied as student data to the tap generation sections 131 and 132. Furthermore, the I code output from the code determination section 215 when it is determined in the least-square error determination section 208 that the square error reaches a minimum is also supplied as student data to the tap generation sections 131 and 132.

Thereafter, the process proceeds to step S32, where the tap generation section 131 assumes, as the subject subframe, the subframe of the synthesized speech supplied as student data from the speech synthesis filter 206, and further assumes the synthesized speech data of that subject subframe in sequence as the subject data, generates, with respect to each of subject data, a prediction tap similarly to the case in the tap generation section 121 of FIG. 5 from the synthesized speech data from the speech synthesis filter 206 and the L code from the code determination section 215, and supplies the prediction tap to the normalization equation addition circuit 134. Furthermore, in step S32, the tap generation section 132 also generates a class tap from the synthesized speech data similarly to the case in the tap generation section 122 of FIG. 5, and supplies the class tap to the classification section 133.

After the process of step S32, the process proceeds to step S33, where the classification section 133 performs classification on the basis of the class tap from the tap generation section 132, and supplies the resulting class code to the normalization equation addition circuit 134.

Then, the process proceeds to step S34, where the normalization equation addition circuit 134 performs addition of the matrix A and the vector v of equation (13), such as that described above, for each class code with respect to the subject data, from the classification section 133, by using as objects speech within the learning speech as teacher data from the A/D conversion section 202, which corresponds to the subject data, and the prediction tap (the prediction tap generated from the subject data) as the student data from the tap generation section 132. Then, the process proceeds to step S35.

In step S35, it is determined whether or not there are any more subframes to be processed as subject subframes. When it is determined in step S35 that there is still a subframe to be processed as a subject subframe, the process returns to step S31, where the next subframe is newly assumed to be a subject subframe, and hereafter, the same processes are repeated.

Furthermore, when it is determined in step S35 that there is no subframe to be processed as a subject subframe, the process proceeds to step S36, where the tap coefficient determination circuit 135 solves the normalization equation generated for each class in the normalization equation addition circuit 134 in order to determine the tap coefficient for each class, supplies the tap coefficient to the address, corresponding to each class, of the coefficient memory 136, whereby the tap coefficient is stored, and the processing is then terminated.

In the above-described manner, the tap coefficient for each class, stored in the coefficient memory 136, is stored in the coefficient memory 124 of FIG. 5.

In the manner described above, since the tap coefficient stored in the coefficient memory 124 of FIG. 5 is determined in such a way that learning is performed so that the prediction error (square error) of a speech prediction value of high-quality speech, obtained by performing a linear prediction computation, statistically becomes a minimum, the speech output by the prediction section 125 of FIG. 5 becomes high-sound quality.

For example, in the embodiment of FIGS. 5 and 13, in addition to synthesized speech data output from the speech synthesis filter 206, an I code (which becomes coded data) contained in coded data is contained in the prediction tap and the class tap. However, as indicated by the dotted lines in FIGS. 5 and 13, the prediction tap and the class tap can be formed so as to contain, instead of the I code or in addition to the I code, one or more of the I code, the L code, the G code, the A code, a linear prediction coefficient $\alpha_p$ obtained from the A code, a gain $\beta$ or $\gamma$ obtained from the G code, and other information (for example, an residual signal e, l or n for obtaining the residual signal e, further, $l/\beta$, $n/\gamma$, etc.) obtained from the L code, the G code, the I code, or the A code. Furthermore, in the CELP method, there is a case in which list interpolation bits, frame energy, etc., are contained in code data as coded data. In this case, the prediction tap and the class tap can also be formed so as to use soft interpolation bits and frame energy.

Next, the above-described series of processes can be performed by hardware and can also be performed by software. In a case where the series of processes are to be performed by software, programs which form the software are installed into a general-purpose computer, etc.

Figure 15:
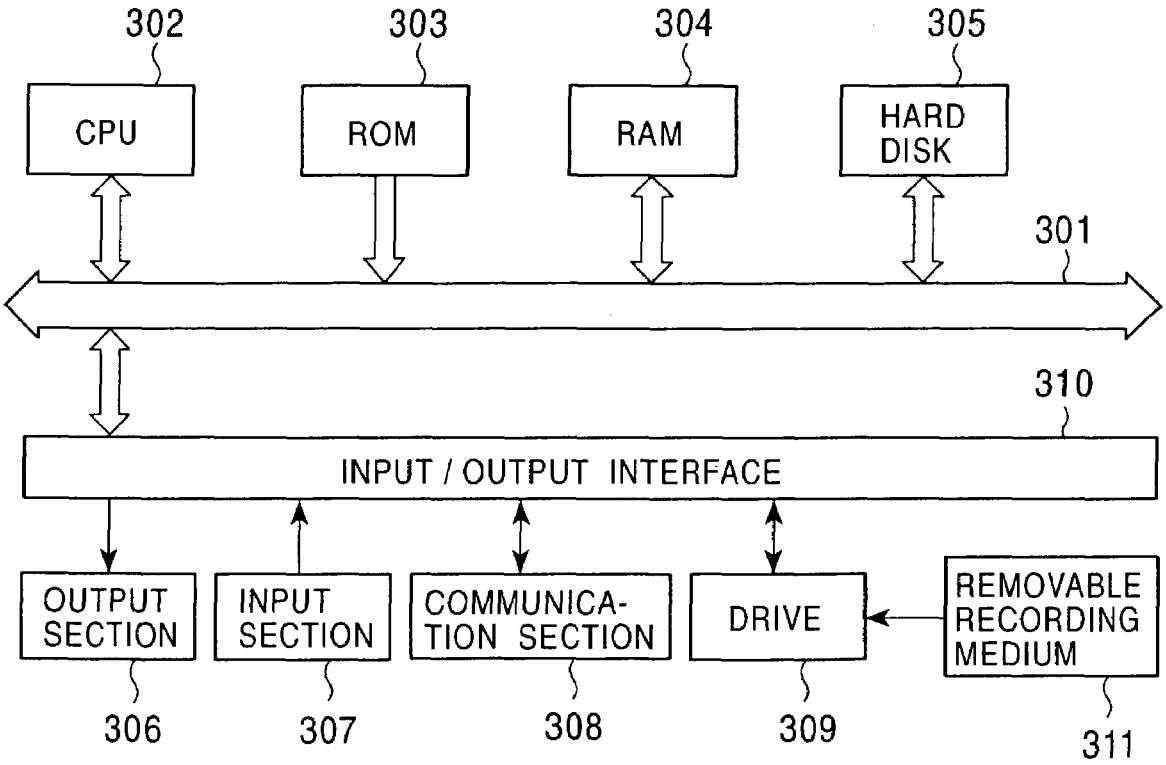
FIG. 15 is a block diagram showing an example of the configuration of an embodiment of a computer according to the present invention.

Therefore, FIG. 15 shows an example of the configuration of an embodiment of a computer into which programs for executing the above-described series of processes are executed are installed.

The programs can be prerecorded in a hard disk 305 and a ROM 303 as a recording medium built into the computer.

Alternatively, the programs may be temporarily or permanently stored (recorded) in a removable recording medium 311, such as a floppy disk, a CD-ROM (Compact Disc Read Only Memory), an MO (Magneto optical) disk, a DVD (Digital Versatile Disc), a magnetic disk, or a semiconductor memory. Such a removable recording medium 311 may be provided as what is commonly called packaged software.

In addition to being installed into a computer from the removable recording medium 311 such as that described above, programs may be transferred in a wireless manner from a download site via an artificial satellite for digital satellite broadcasting or may be transferred by wire to a computer via a network, such as a LAN (Local Area Network) or the Internet, and in the computer, the programs which are transferred in such a manner are received by a communication section 308 and can be installed into the hard disk 305 contained therein.

The computer has a CPU (Central Processing Unit) 302 contained therein. An input/output interface 310 is connected to the CPU 302 via a bus 301. When a command is input as a result of a user operating an input section 307 formed of a keyboard, a mouse, a microphone, etc., via the input/output interface 310, the CPU 302 executes a program stored in the ROM (Read Only Memory) 303 in accordance with the command. Alternatively, the CPU 302 loads a program stored in the hard disk 305, a program which is transferred from a satellite or a network, which is received by the communication section 308, and which is installed into the hard disk 305, or a program which is read from the removable recording medium 311 loaded into a drive 309 and which is installed into the hard disk 305, to a RAM (Random Access Memory) 304, and executes the program. As a result, the CPU 302 performs processing in accordance with the above-described flowcharts or processing performed according to the constructions in the above-described block diagrams. Then, the CPU 302 outputs the processing result, for example, from an output section 306 formed of an LCD (Liquid Crystal Display), a speaker, etc., via the input/output interface 310, as required, or transmits the processing result from the communication section 308, and furthermore, records the processing result in the hard disk 305.

Here, in this specification, processing steps which describe a program for causing a computer to perform various types of processing need not necessarily perform processing in a time series along the described sequence as a flowchart and contain processing performed in parallel or individually (for example, parallel processing or object-oriented processing) as well.

Furthermore, a program may be such that it is processed by one computer or may be such that it is processed in a distributed manner by plural computers. In addition, a program may be such that it is transferred to a remote computer and is executed thereby.

Although in this embodiment, no particular mention is made as to what kinds of learning speech signals are used as learning speech signals, in addition to speech produced by a human being, for example, a musical piece (music), etc., can be employed as learning speech signals. According to the learning apparatus such as that described above, when reproduced human speech is used as a learning speech signal, a tap coefficient such as that which improves the sound quality of human speech is obtained. When a musical piece is used, a tap coefficient such as that which improves the sound quality of the musical piece will be obtained.

Although tap coefficients are stored in advance in the coefficient memory 124, etc., in the mobile phone 101, the tap coefficients to be stored in the coefficient memory 124, etc., can be downloaded from the base station 102 (or the exchange 103) of FIG. 3, a WWW (World Wide Web) server (not shown), etc. That is, as described above, tap coefficients suitable for certain kinds of speech signals, such as for human speech production or for a musical piece, can be obtained through learning. Furthermore, depending on teacher data and student data used for learning, tap coefficients by which a difference occurs in the sound quality of synthesized speech can be obtained. Therefore, such various kinds of tap coefficients can be stored in the base station 102, etc., so that a user is made to download tap coefficients desired by the user. Such a downloading service of tap coefficients can be performed free or for a charge. Furthermore, when downloading service of tap coefficients is performed for a charge, the cost for downloading the tap coefficients can be charged, for example, together with the charge for telephone calls of the mobile phone 101.

Furthermore, the coefficient memory 124, etc., can be formed by a removable memory card which can be loaded into and removed from the mobile phone 101, etc. In this case, if different memory cards in which various types of tap coefficients, such as those described above, are stored are provided, it becomes possible for the user to load a memory card in which desired tap coefficients are stored into the mobile phone 101 and to use it depending on the situation.

In addition, the present invention can be widely applied to a case in which, for example, synthesized speech is produced from codes obtained as a result of coding by a CELP method such as VSELP (Vector Sum Excited Linear Prediction), PSI-CELP (Pitch Synchronous Innovation CELP), or CS-ACELP (Conjugate Structure Algebraic CELP).

Furthermore, the present invention is not limited to the case where synthesized speech is decoded from codes obtained as a result of coding by a CELP method, and can be widely applied to a case in which the original data is decoded from coded data having information (decoding information) used for decoding in predetermined units. That is, the present invention can also be applied to coded data such that, for example, an image is coded by a JPEG (Joint Photographic Experts Group) method having a DCT (Discrete Cosine Transform) coefficient in predetermined block units.

Furthermore, although in this embodiment, prediction values of a residual signal and a linear prediction coefficient are determined by linear first-order prediction computation using tap coefficients, additionally, these prediction values can also be determined by high-order prediction computation of a second or higher order.

For example, in Japanese Unexamined Patent Application Publication No. 8-202399, a method in which the sound quality of synthesized speech is improved by causing the synthesized speech to pass through a high-frequency accentuation filter is disclosed. However, the present invention differs from the invention described in Japanese Unexamined Patent Application Publication No. 8-202399 in that a tap coefficient is obtained through learning, a tap coefficient used for prediction calculation is adaptively determined according to classification results, and further, the prediction tap, etc. is generated not only from synthesized speech, but is also generated from an I code, etc., contained in coded data.

INDUSTRIAL APPLICABILITY

According to the data processing apparatus, the data processing method, the program, and the recording medium of the present invention, a tap used for a predetermined process is generated by extracting decoded data in a predetermined positional relationship with subject data of interest within the decoded data such that coded data is decoded and by extracting decoding information in predetermined units according to a position of the subject data in predetermined units, and the predetermined process is performed by using the tap. Therefore, for example, it becomes possible to obtain high-quality decoded data.

According to the data processing apparatus, the data processing method, the program, and the recording medium of the present invention, decoded data as student data serving as a student is generated by coding teacher data serving as a teacher into coded data having decoding information in predetermined units and by decoding the coded data. Furthermore, a prediction tap used to predict teacher data is generated by extracting decoded data in a predetermined positional relationship with subject data of interest within the decoded data as the student data and by extracting the decoding information in predetermined units according to a position of the subject data in predetermined units. Then, learning is performed so that a prediction error of the prediction value of the teacher data obtained by performing a predetermined prediction computation by using the prediction tap and the tap coefficient statistically becomes a minimum, and the tap coefficient is determined. Therefore, it becomes possible to obtain a tap coefficient for decoding high-quality decoded data from the coded data.

The invention claimed is:

1. A data processing apparatus for processing coded data including decoding information used for decoding in predetermined units, said data processing apparatus comprising:

tap generation means for generating a prediction tap and a class tap, said prediction tap and class tap generated based on (a) extracting decoded data in a predetermined positional relationship with data of interest within the decoded data such that said coded data is decoded and (b) extracting decoding information in predetermined units according to the position of said data of interest in a unit which contains said data of interest;

memory means for storing predetermined tap coefficients for each class of said data of interest, said predetermined tap coefficients determined in advance by a learning process based on a learning signal;

classification means for performing classification on said data of interest and said decoding information of said predetermined units on the basis of (a) said class tap, and (b) the position of said data of interest in said unit and for outputting class code as a result of said classiflcation; and processing means for performing a predetermined prediction computation using (a) said tap coefficient corresponding to the class obtained as a result of the classification and (b) said prediction tap, thereby determining a prediction value corresponding to the decoded data, wherein the number of classes, corresponding to each decoding information of said predetermined units, are determined based on the position of said data of interest in said unit.

2. A data processing apparatus according to claim 1, further comprising tap coefficient obtaining means for obtaining a tap coefficient from said memory means, wherein said processing means determines the prediction value corresponding to teacher data serving as a teacher in said learning process by performing a predetermined prediction computation by using said prediction tap and said tap coefficient.

3. A data processing apparatus according to claim 2, wherein said processing means determines said prediction value by performing a linear first-order prediction computation by using said prediction tap and a class tap.

4. A data processing apparatus according to claim 1, wherein said processing means performs classification by providing a weight to said decoding information which forms said class tap in predetermined units.

5. A data processing apparatus according to claim 4, wherein said processing means performs classification by providing a weight to said decoding information in predetermined units according to a position of said data of interest in said predetermined units.

6. A data processing apparatus according to claim 4, wherein said processing means performs classification by providing a weight such that the number of all classes obtained by said classification becomes fixed on said decoding information in predetermined units.

7. A data processing apparatus according to claim 1, wherein said tap generation means extracts said decoding data at a position near said data of interest or said decoding information in predetermined units.

8. A data processing apparatus according to claim 1, wherein said coded data is such that speech is coded.

9. A data processing apparatus according to claim 8, wherein said coded data is such that speech is coded by a CELP (Code Excited Linear coding) method.

10. A data processing method for processing coded data including decoding information used for decoding in predetermined units, said data processing method comprising:

storing predetermined tap coefficients determined in advance by a learning process on a learning signal for each class of data of interest;

generating a prediction tap and a class tap based upon (a) extracting decoded data in a predetermined positional relationship with data of interest within the decoded data such that said coded data is decoded and (b) extracting decoding information in predetermined units according to the position of said data of interest in a unit which contains said data of interest;

classifying said data of interest and said decoding information of said predetermined units on the basis of (a) said class tap and (b) the position of said data of interest in said unit, and outputting class code as a result of thereof;

performing a predetermined prediction computation using (a) said tap coefficient corresponding to the class obtained as a result of the classification and (b) said prediction tap; and determining a prediction value corresponding to the decoded data, wherein the number of classes, corresponding to each decoding information of said predetermined units, are determined based on the position of said data of interest in said unit.

11. A data processing apparatus for learning a predetermined tap coefficient used to process coded data including decoding information used for decoding in predetermined units, said data processing apparatus comprising:

student data generation means for generating decoded data as student data serving as a student by coding teacher serving as a teacher into said coded data having decoding information in predetermined units and by decoding the coded data;

prediction tap generation means for generating a prediction tap used to predict teacher data by extracting said decoded data in a predetermined positional relationship with subject data of interest within said decoded data as the student data and by extracting said decoding information in said predetermined units according to a position of said subject data in said predetermined units;

memory means for storing predetermined tap coefficients determined in advance by learning;

learning means for learning so that a prediction error of the prediction value of said teacher data obtained by performing a predetermined prediction computation by using said prediction tap and said stored tap coefficient statistically becomes a minimum, and for determining said tap coefficient;

class tap generation means for generating a class tap used for classification for classifying said subject data by extracting said decoded data in a predetermined positional relationship with said subject data and by extracting said decoding information in predetermined units according to a position of said subject data in said predetermined unit; and classification means for performing classification on said subject data on the basis of said class tap, wherein said learning means determines said tap coefficient for each class obtained as a result of classification by said classification means and the number of classes, corresponding to each decoding information, are determined based on the position of said subject data in a unit which contains said subject data.

12. A data processing apparatus according to claim 11, wherein said learning means performs learning so that a prediction error of the prediction value of said teacher data obtained by performing a linear first-order prediction computation by using said prediction tap and said tap coefficient statistically becomes a minimum.

13. A data processing apparatus according to claim 11, wherein said classification means performs classification by providing a weight to decoding information which forms said class tap in said predetermined units.

14. A data processing apparatus according to claim 13, wherein said classification means performs classification by providing a weight to said decoding information in predetermined units according to a position of said subject data in said predetermined unit.

15. A data processing apparatus according to claim 13, wherein said classification means performs classification by providing a weight such that the number of all classes obtained by said classification becomes fixed to said decoding information in predetermined units.

16. A data processing apparatus according to claim 11, wherein said prediction tap generation means or said class tap generation means extracts said decoded data at a position near said subject data or said decoding information in predetermined units.

17. A data processing apparatus according to claim 11, wherein said teacher data is speech data.

18. A data processing apparatus according to claim 17, wherein student data generation means codes speech data as said teacher data by a CELP (Code Excited Linear coding) method.

19. A data processing method for learning a predetermined tap coefficient used to process coded data including decoding information used for decoding in predetermined units, said data processing method comprising:

a student data generation step of generating decoded data as student data serving as a student by coding teacher serving as a teacher into coded data having said decoding information in predetermined units and by decoding the coded data;

a prediction tap generation step of generating a prediction tap used to predict teacher data by extracting said decoded data in a predetermined positional relationship with subject data of interest within said decoded data as the student data and by extracting said decoding information in said predetermined units according to a position of said subject data in said predetermined units;

storing predetermined tap coefficients determined in advance by learning;

a learning step of learning so that a prediction error of the prediction value of said teacher data obtained by performing a predetermined prediction computation by using said prediction tap and said stored tap coefficient statistically becomes a minimum, and for determining said tap coefficient;

class tap generation step for generating a class tap used for classification for classifying said subject data by extracting said decoded data in a predetermined positional relationship with said subject data and by extracting said decoding information in predetermined units according to a position of said subject data in said predetermined unit; and classification step for performing classification on said subject data on the basis of said class tap, wherein said learning step determines said tap coefficient for each class obtained as a result of classification by said classification step and the number of classes, corresponding to each decoding information, are determined based on the position of said subject data in a unit which contains said subject data.

* * * * *